US011807966B2

(12) United States Patent
Kato et al.

(10) Patent No.: US 11,807,966 B2
(45) Date of Patent: Nov. 7, 2023

(54) UPPER FEED DEVICE

(71) Applicant: BROTHER KOGYO KABUSHIKI KAISHA, Nagoya (JP)

(72) Inventors: Masahisa Kato, Nagoya (JP); Nobuhiko Funato, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 160 days.

(21) Appl. No.: 17/358,069

(22) Filed: Jun. 25, 2021

(65) Prior Publication Data

US 2022/0034009 A1 Feb. 3, 2022

(30) Foreign Application Priority Data

Jul. 31, 2020 (JP) ..... 2020-131240

(51) Int. Cl.
*D05B 29/12* (2006.01)
*D05B 27/04* (2006.01)

(52) U.S. Cl.
CPC ..... *D05B 29/12* (2013.01); *D05B 27/04* (2013.01)

(58) Field of Classification Search
CPC ..... D05B 29/12; D05B 29/06; D05B 29/00; D05B 29/04; D05B 29/08; D05B 27/04
See application file for complete search history.

(56) References Cited

U.S. PATENT DOCUMENTS 3,334,605 A * 8/1967 Boser ..... D05B 29/08 112/235
4,359,955 A * 11/1982 Hida ..... D05B 29/12 112/150
4,646,668 A * 3/1987 Biermann ..... D05B 29/08 112/311

(Continued)

FOREIGN PATENT DOCUMENTS

CH 369009 A * 4/1963 ..... D05B 29/00
CH 372908 A * 10/1963 ..... D05B 27/04

(Continued)

OTHER PUBLICATIONS

BrotherSupportSewing, Attaching the dual feed foot, May 9, 2017, YouTube (https://www.youtube.com/watch?v=DhFckZsTDyg) (last accessed Jan. 19, 2023). (Year: 2017).*

(Continued)

*Primary Examiner* — Patrick J. Lynch
(74) *Attorney, Agent, or Firm* — Oliff PLC

(57) ABSTRACT

An upper feed device includes a main body portion configured to be mounted to a presser bar of a sewing machine, and a presser foot configured to be detachably mounted to the main body portion. The main body portion has an upper feed dog, a first mounting portion, and a second mounting portion. The first mounting portion has a first groove opening downward, and the second mounting portion has a second groove opening downward. The presser foot has a presser plate, a first opposing portion, a second opposing portion, a first pin, a first protruding portion, a second pin, (Continued)

and a second protruding portion. An opening is formed in the presser plate. The first pin is configured to rotatably fit into the first groove. The second pin is configured to rotatably fit into the second groove.

11 Claims, 15 Drawing Sheets

(56) References Cited

U.S. PATENT DOCUMENTS

2007/0266920 A1* 11/2007 Fujihara ..... D05B 27/04 112/313
2012/0097085 A1* 4/2012 Fukao ..... D05B 29/12 112/240
2014/0000499 A1* 1/2014 Kato ..... D05B 27/04 112/320
2020/0048808 A1* 2/2020 Azuma ..... D05B 29/00

FOREIGN PATENT DOCUMENTS

JP H03-143475 A 6/1991
JP H10-108988 A 4/1998

OTHER PUBLICATIONS

English translation of CH372908 to Gegauf, Oct. 1963, accessed via espacenet.com (last visited Jan. 26, 2023). (Year: 2023).*

* cited by examiner

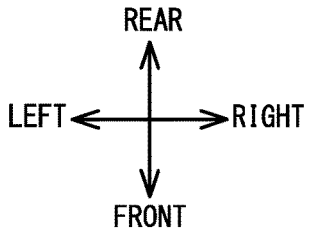
FIG. 3A
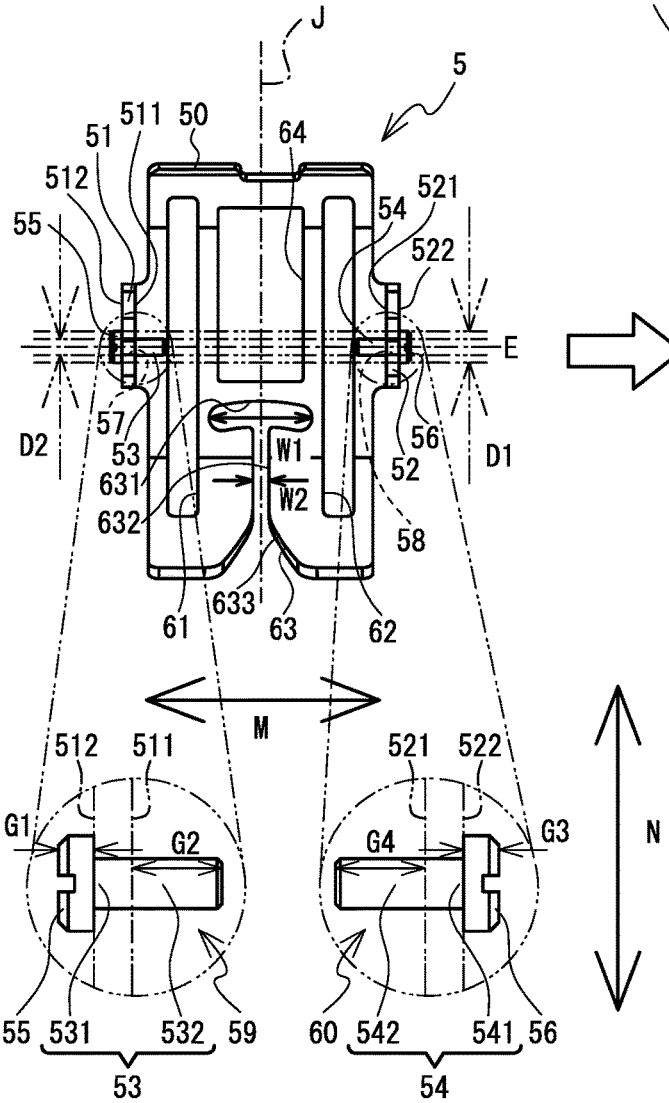
FIG. 3B
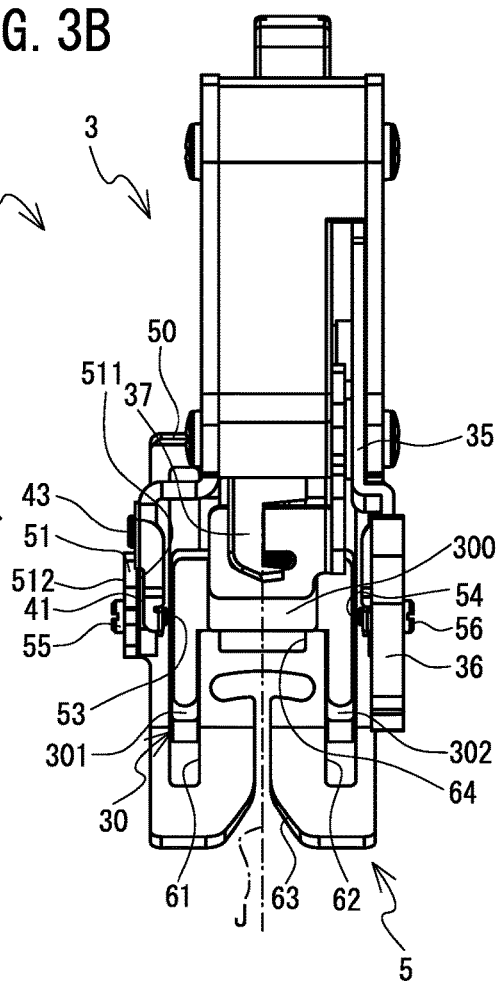

UP
FRONT
REAR
DOWN 36
35
2
37
38
30
32
302
304
56
65
52
50
44
42
3
5
2
37
35
36
32
38
30
302
65
56
52
50
44
42
3
5

UPPER FEED DEVICE

CROSS-REFERENCE TO RELATED APPLICATION

This application claims priority to Japanese Patent Application No. 2020-131240 filed Jul. 31, 2020, the content of which is hereby incorporated herein by reference in its entirety.

BACKGROUND

The present disclosure relates to an upper feed device mounted to a presser bar of a sewing machine.

A conventional upper feed device is provided with a main body portion and a presser foot. The main body portion is detachably mounted to a presser bar of a sewing machine. The main body portion is provided with an upper feed dog and a pair of arm portions. The upper feed dog conveys an object to be sewn in a conveyance direction by moving up and down in conjunction with the up and down movement of a needle bar of the sewing machine and sandwiching the object to be sewn with the feed dog of the sewing machine when the upper feed dog is down. Each of the pair of arm portions has an engagement shaft portion that extends in the conveyance direction of the sewing machine, and these engagement shaft portions protrude toward the other. The pair of arm portions rotatably support the presser foot by the engagement shaft portions being inserted through holes formed in the presser foot. The presser foot presses on the object to be sewn from above.

SUMMARY

With the upper feed device described above, when replacing the presser foot on the main body portion according to the type of object to be sewn, a user must remove the engagement shaft portions of the main body portion from the holes in the presser foot. Therefore, with a conventional upper feed device, the user must remove the upper feed device from the presser bar of the sewing machine to replace the presser foot, which makes replacing the presser foot troublesome.

Embodiments of the broad principles derived herein provide an upper feed device in which the operation of replacing a presser foot is simpler than it was in the past.

Embodiments provide an upper feed device that includes a main body portion and a presser foot. The main body portion is configured to be mounted to a presser bar of a sewing machine. The main body portion has an upper feed dog, a first mounting portion, and a second mounting portion. The upper feed dog is configured to convey an object to be sewn in conjunction with up and down movement of a needle bar of the sewing machine. The first mounting portion has a first groove opening downward, and the second mounting portion has a second groove opening downward. The presser foot is configured to be detachably mounted to the main body portion. The presser foot has a presser plate, a first opposing portion, a second opposing portion, a first pin, a first protruding portion, a second pin, and a second protruding portion. An opening through which the upper feed dog is inserted is formed in the presser plate. The first opposing portion extends upward from the presser plate on one side of the opening in the lateral direction of the opening. The first pin protrudes on a side with the opening from the first opposing portion, and is configured to rotatably fit into the first groove of the first mounting portion. The first protruding portion protrudes on the opposite side to the side with the opening from the first opposing portion. The second opposing portion extends upward from the presser plate on other side of the opening, in the lateral direction of the opening, and faces the first opposing portion. The second pin protrudes on a side with the opening from the second opposing portion, and is configured to rotatably fit into the second groove of the second mounting portion. The second protruding portion protrudes on an opposite side to the side with the opening from the second opposing portion.

BRIEF DESCRIPTION OF THE DRAWINGS

Embodiments will be described below in detail with reference to the accompanying drawings in which:

FIG. 3A is a plan view of the presser foot, and FIG. 3B is a plan view of the upper feed device with the presser foot mounted to the main body portion;

DETAILED DESCRIPTION OF THE EXEMPLARY EMBODIMENTS

Figure 1:
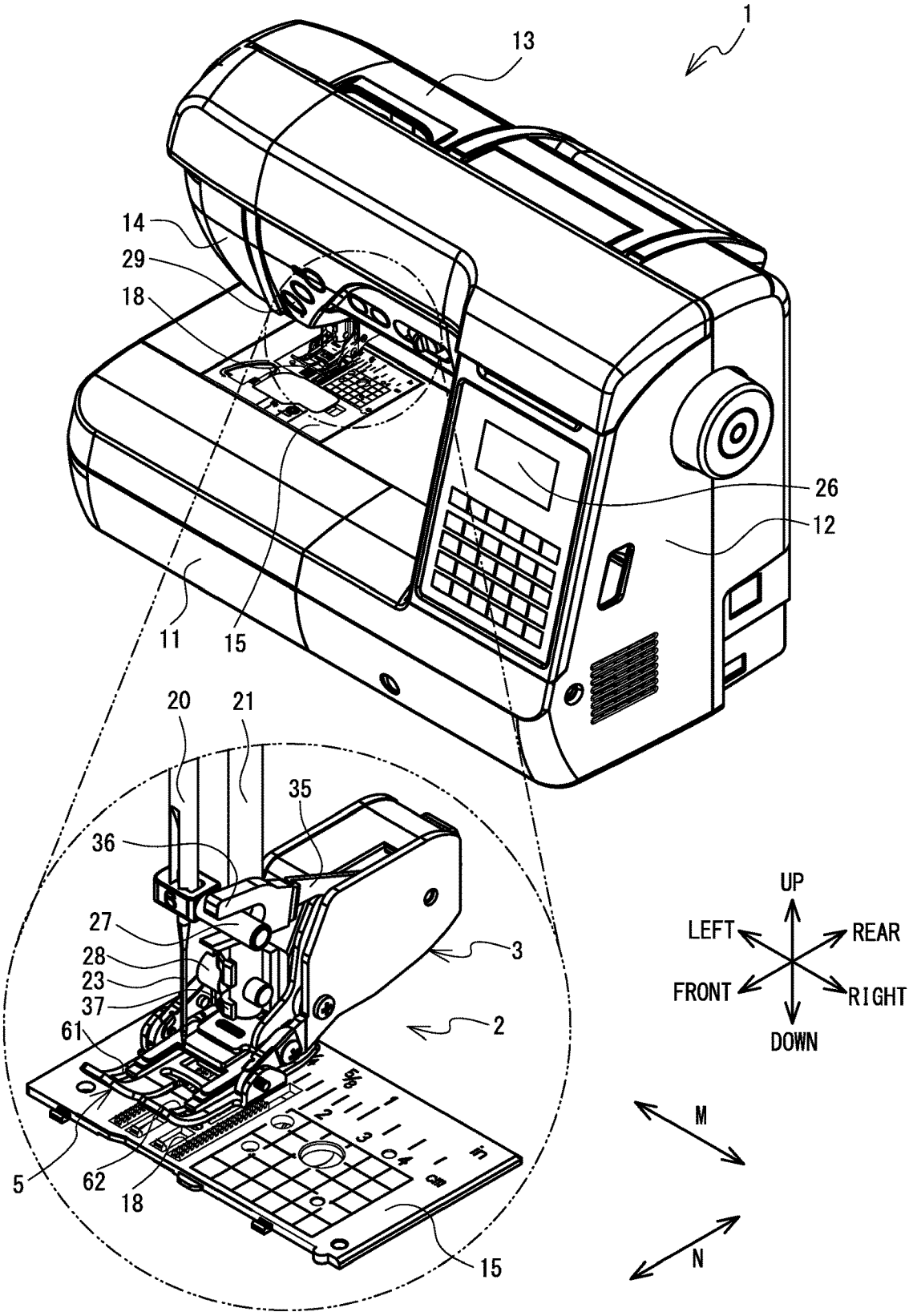
FIG. 1 is a perspective view of a sewing machine to which an upper feed device is mounted.

Exemplary embodiments of the present disclosure will be described with reference to the drawings. The physical structure of an upper feed device 2 and a sewing machine 1 to which the upper feed device 2 is mounted will be described with reference to FIG. 1. The up-down, lower left, upper right, upper left, and lower right directions in FIG. 1 correspond to the up-down, front, rear, left, and right directions, respectively, of the upper feed device 2 and the sewing machine 1. That is, in a state in which the upper feed device 2 is mounted to the sewing machine 1, a lateral direction M (hereinafter, also simply referred to as "direction M") of a presser foot 5, and, referring to FIG. 3, openings 61 and 62, described later, is the left-right direction of the upper feed device 2. A longitudinal direction N (hereinafter, also simply referred to as "direction N") of the presser foot 5 and the openings 61 and 62 is the front-rear direction of the upper feed device 2. The extending direction of a presser bar 21 to which the upper feed device 2 is mounted is the up-down direction of the upper feed device 2.

As shown in FIG. 1, the sewing machine 1 is provided with a bed portion 11, a pillar portion 12, an arm portion 13, and a head portion 14. The bed portion 11 is a base portion of the sewing machine 1 that extends in the left-right direction and has a needle plate 15 on the upper surface. The bed portion 11 is provided with a feed mechanism below the needle plate 15, and this feed mechanism conveys an object to be sewn forwards or backwards by driving a feed dog 18. The pillar portion 12 stands upright from the right end portion of the bed portion 11. An LCD 26 is provided on the front surface of the pillar portion 12. The arm portion 13 extends toward the left from the upper end of the pillar portion 12 and faces the bed portion 11. Various switches including a start/stop switch 29 are provided on the front surface of the arm portion 13. The start/stop switch 29 is used to start or stop operation of the sewing machine 1, that is, to input an instruction to start or stop sewing. The head portion 14 is a portion that is connected to the left tip end portion of the arm portion 13. A needle bar 20, a presser bar 21, a needle bar up-down moving mechanism, and a pivot mechanism and the like are provided on the head portion 14. A sewing needle 23 is detachably mounted to the lower end of the needle bar 20. The needle bar 20 is provided with a shaft portion 27 that protrudes toward the right on the lower end portion. The presser bar 21 extends in the up-down direction to the rear side of the needle bar 20, and the upper feed device 2 is detachably mounted to the lower end of the presser bar 21. The needle bar up-down moving mechanism moves the needle bar 20 up and down. The pivot mechanism moves the needle bar 20 left and right.

The upper feed device 2 will be described based on a case in which the upper feed device 2 is mounted to the sewing machine 1, with reference to FIG. 1 to FIG. 4. As shown in FIG. 1, the upper feed device 2 is detachably mounted by a fixing screw 28 at the lower end of the presser bar 21. The upper feed device 2 moves a plurality of objects to be sewn that are vertically overlapped with each other using an upper feed dog 30 in cooperation with the feed dog 18 provided on the bed portion 11, while pressing the objects to be sewn that are on the bed portion 11 toward the upper surface side of the needle plate 15 with the presser foot 5. The upper feed device 2 is used when performing quilting in which two objects to be sewn are sewn together with cotton sandwiched therebetween, for example. Aside from the presser foot 5, the upper feed device 2 is also equipped with various other types of presser feet, such as a presser foot 7 that will be described later with reference to FIG. 5. A user attaches the desired presser foot and then sews the objects to be sewn. The presser foot 5 is used when sewing a zigzag stitch. Although not shown in the drawings, there are also other presser feet such as a presser foot that has been surface treated on the cloth pressing surface thereof in order to reduce friction with the object to be sewn, and a presser foot made of transparent resin to make it easier to see the needle drop position of the sewing needle 23. Hereinafter, the structure of the upper feed device 2 will be described using a case in which the presser foot 5 is mounted to a main body portion 3 as an example.

As shown in FIG. 2, the upper feed device 2 is provided with the main body portion 3 and the presser foot 5. The main body portion 3 is mounted to the presser bar 21 of the sewing machine 1. The main body portion 3 is provided with the upper feed dog 30, a first mounting portion 31, a second mounting portion 32, urging members 41 and 42, a pivot lever 35, and a mounting portion 37. The upper feed dog 30 conveys the object to be sewn in conjunction with the up-and-down movement of the needle bar 20 of the sewing machine 1. The upper feed dog 30 is substantially U-shaped and opens toward the front when viewed from above, and has a rear end portion 300 and arm portions 301 and 302 that extend toward the front side from the left and right end portions of the rear end portion 300. The arm portions 301 and 302 are arranged between the first mounting portion 31 and the second mounting portion 32 in the left-right direction. A plurality of teeth 303 are arranged lined up in the front-rear direction on the lower surface of the arm portion 301. A plurality of teeth 304 are arranged lined up in the front-rear direction on the lower surface of the arm portion 302. The rear end portion 300 of the upper feed dog 30 is connected to a transfer lever (not shown in the drawings). The transfer lever causes the upper feed dog 30 to move relatively in response to pivoting of the pivot lever 35. The upper feed dog 30 is urged upward by an urging member (not shown in the drawings).

The first mounting portion 31 has a plate shape that extends forward from the front lower portion of the left surface of the main body portion 3 to the left of the arm portion 301. The first mounting portion 31 has, on a front end portion thereof, a first groove 33 that opens downward. The second mounting portion 32 has a plate shape that extends forward from the front lower portion of the right surface of the main body portion 3 to the right of the arm portion 302. The first mounting portion 31 and the second mounting portion 32 faces each other in the left-right direction. The second mounting portion 32 has, on a front end portion thereof, a second groove 34 that opens downward.

The urging member 41 is a thin plate-shaped plate spring that is bent following the left surface, the upper surface, and the right surface of the first mounting portion 31, and extends in the front-rear direction. The rear end portion of the urging member 41 is fixed to the left surface of the first mounting portion 31 by a screw 43 to the rear side of the first groove 33. The front end portion of the urging member 41 is arranged to the right of the right surface of the first mounting portion 31, and faces the front side portion of the first groove 33. The urging member 41 urges a first pin 53, described later, that is fitted into the first groove 33 of the first mounting portion 31 in a direction intersecting with the downward direction, that is, toward the rear. The urging member 42 has a structure symmetrical to the urging member 41. The urging member 42 is a thin plate-shaped plate spring that is bent following the right surface, the upper surface, and the left surface of the second mounting portion 32, and extends in the front-rear direction. The rear end portion of the urging member 42 is fixed to the right surface of the second mounting portion 32 by a screw 44 to the rear side of the second groove 34. The front end portion of the urging member 42 is arranged to the left of the left surface of the second mounting portion 32, and faces the front side portion of the second groove 34. The urging member 42 urges a second pin 54, described later, that is fitted into the second groove 34 of the second mounting portion 32 in a direction (rearward) intersecting with the downward direction.

The pivot lever 35 is supported by the main body portion 3 in a manner able to pivot around a pivot shaft that extends in the left-right direction and is provided on a rear portion of the main body portion 3. The front end portion of the pivot lever 35 is provided with a groove-like engagement portion 36 that is open on the front side. The engagement portion 36 is provided above the second mounting portion 32. The shaft portion 27 (refer to FIG. 1) provided on the lower end portion of the needle bar 20 (refer to FIG. 1) is inserted into the groove-like portion of the engagement portion 36. As a result, the pivot lever 35 oscillates up and down around the pivot shaft as the needle bar 20 moves up and down.

The mounting portion 37 detachably mounts the main body portion 3 of the upper feed device 2 to the presser bar 21 of the sewing machine 1. The mounting portion 37 is provided between the first mounting portion 31 and the second mounting portion 32 in the left-right direction. The mounting portion 37 is provided farther to the rear in the front-rear direction than the first groove 33 of the first mounting portion 31 and the second groove 34 of the second mounting portion 32. The mounting portion 37 is groove-like with the right side open when viewed from above. The mounting portion 37 is provided with a recessed portion 38 that is recessed toward the rear from the front end, in a vertically center portion of the mounting portion 37. The user detachably mounts the main body portion 3 of the upper feed device 2 to the presser bar 21 of the sewing machine 1 by inserting the fixing screw 28 through the recessed portion 38 from the left side and screwing the fixing screw 28 into a screw hole in the presser bar 21, while the lower end of the presser bar 21 is arranged in the groove-like portion of the mounting portion 37 from the left side of the presser bar 21.

The presser foot 5 is detachably mounted to the main body portion 3. As shown in FIG. 3A, the presser foot 5 is provided with a presser plate 50, a first opposing portion 51, a second opposing portion 52, the first pin 53, the second pin 54, a first protruding portion 55, and a second protruding portion 56.

The presser plate 50 has a rectangular plate shape that is long in the front-rear direction when viewed from above. The presser plate 50 extends horizontally. As shown in FIG. 2, the front end portion and the rear end portion of the presser plate 50 both curve upwards. The length F1 from a bottom surface 65 of the presser plate 50 to the front end of the presser plate 50 in the up-down direction is longer than the length F2 from the bottom surface 65 of the presser plate 50 to the rear end of the presser plate 50. As shown in FIG. 3A, the presser plate 50 has a symmetrical shape with respect to the center J in the left-right direction. The openings 61 and 62, a cutout portion 63, and an opening 64 are formed in the presser plate 50. The openings 61 and 62 are both holes that have a rectangular shape that is long in the front-rear direction when viewed from above and pass through in the up-down direction. The opening 61 is formed to the left of the opening 62. As shown in FIG. 3B, when the presser foot 5 is mounted to the main body portion 3, the arm portions 301 and 302 of the upper feed dog 30 are inserted through the openings 61 and 62, respectively.

As shown in FIG. 3A, the cutout portion 63 and the opening 64 are formed between the openings 61 and 62 in the left-right direction. The cutout portion 63 is a cutout formed in a T-shape, when viewed from above, from the front end of the presser plate 50 toward the rear in the center of the presser plate 50 in the left-right direction. The cutout portion 63 has a rear end portion 631, a straight portion 632, and a front end portion 633. The rear end portion 631 extends in the left-right direction. When the upper feed device 2 is mounted to the lower end of the presser bar 21 and the sewing machine 1 is driven, the sewing needle 23 passes through the rear end portion 631. The straight portion 632 extends in a straight line toward the front from the center of the rear end portion 631 in the left-right direction. The front end portion 633 is a portion that is connected to the front end of the straight portion 632 and is cut out such that the width in the left-right direction becomes shorter from the front end of the presser plate 50 toward the rear. The width W1 of the rear end portion 631 in the left-right direction is longer than the width W2 of the straight portion 632 in the left-right direction. The opening 64 is a hole that has a rectangular shape when viewed from above, and is formed rearward of the cutout portion 63 and passes through in the up-down direction. The rear ends of the openings 61 and 62 are farther rearward than the rear end of the opening 64. The front ends of the openings 61 and 62 are farther forward than the rear end of the cutout portion 63. The bottom surface 65 of the presser plate 50 extends horizontally. The bottom surface 65 of the presser plate 50 is also the bottom surface 65 of the presser foot 5.

Figure 2A:
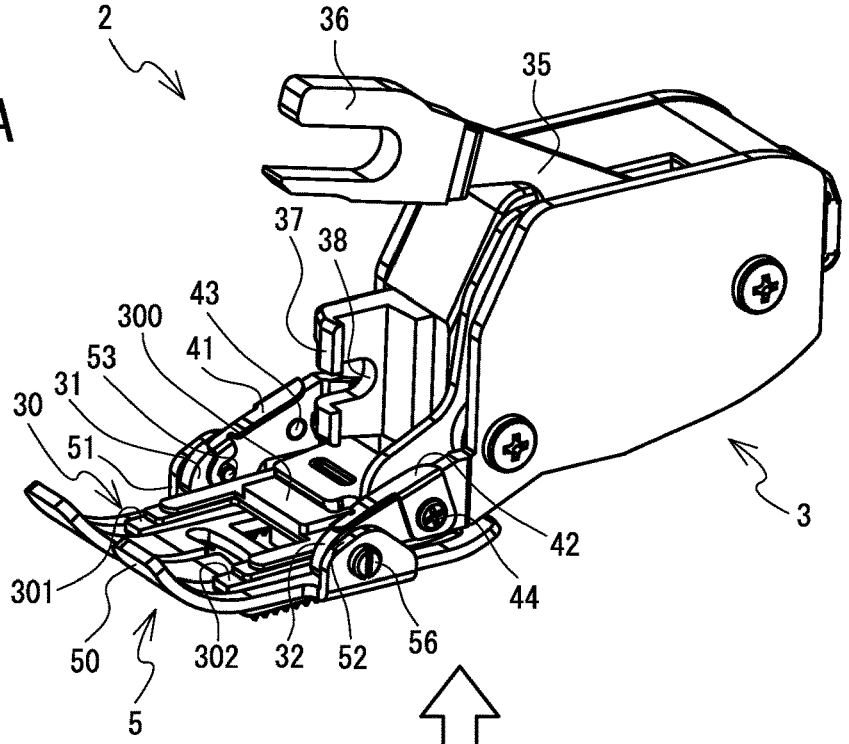
FIG. 2A is a perspective view of the upper feed device with a presser foot mounted to a main body portion.
Figure 2B:
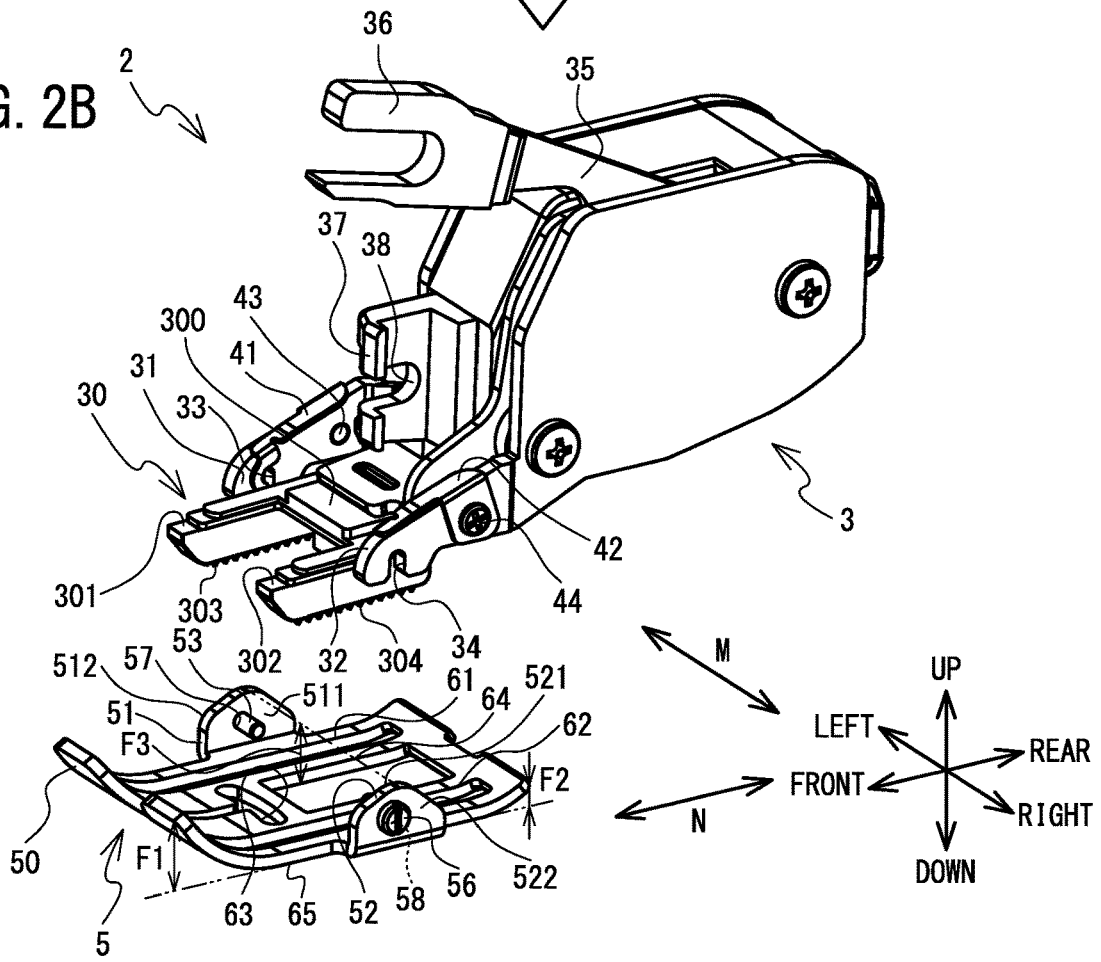
FIG. 2B is a perspective view of the upper feed device with the presser foot removed from the main body portion.

As shown in FIG. 2B, the first opposing portion 51 extends upward from the presser plate 50 on one side, i.e., the left side, of the openings 61 and 62 in direction M. The first opposing portion 51 has a plate shape that has a vertical opposing surface 511 and a gripping surface 512 in the left-right direction. The opposing surface 511 is the surface on the side facing the second opposing portion 52, i.e., the right surface of the first opposing portion 51. The gripping surface 512 is the surface on the side away from the second opposing portion 52, i.e., the left surface of the first opposing portion 51. A first hole 57 that passes through in direction M is formed in the first opposing portion 51. The lower end of the first hole 57 is positioned above the bottom surface 65 of the presser plate 50.

The second opposing portion 52 extends upward from the presser plate 50 on the other side, i.e., the right side, of the openings 61 and 62, and faces the first opposing portion 51 in direction M. The second opposing portion 52 has a plate shape perpendicular to the left-right direction, and the second opposing portion 52 has an opposing surface 521 and a gripping surface 522. The opposing surface 521 is the surface on the side facing the first opposing portion 51, i.e., the left surface of the second opposing portion 52. The gripping surface 522 is the surface on the side away from the first opposing portion 51, i.e., the right surface of the second opposing portion 52. A second hole 58 that passes through in direction M is formed in the second opposing portion 52. The lower end of the second hole 58 is positioned above the bottom surface 65 of the presser plate 50. The length F3 from the bottom surface 65 of the presser plate 50 to the upper end of the first opposing portion 51 and the upper end of the second opposing portion 52 in the up-down direction is substantially the same as the length F1 from the bottom surface 65 of the presser plate 50 to the front end of the presser plate 50.

As shown in FIG. 3A, the first pin 53 protrudes toward the side (the right side) with the openings 61 and 62 from the first opposing portion 51, and rotatably fits into the first groove 33 of the first mounting portion 31. The first pin 53 is provided with a first insertion portion 531 and a first fitting portion 532. The first insertion portion 531 is the left end portion of the first pin 53 and is inserted into the first hole 57 of the first opposing portion 51. The first fitting portion 532 is a portion that includes the right end portion of the first pin 53 and fits into the first groove 33 of the first mounting portion 31. The first fitting portion 532 of the first pin 53 protrudes in a cylindrical shape with a substantially constant diameter toward the right from the opposing surface 511 of the first opposing portion 51. The right end of the first pin 53, i.e., the right end of the first fitting portion 532, is farther to the left than the left end of the opening 61. No bumps and dips such as screw threads are formed on the outer periphery of the first pin 53. Instead, the outer periphery of the first pin 53 extends smoothly in direction M. The maximum length of the first fitting portion 532 in the radial direction orthogonal to direction M, i.e., the diameter of the first fitting portion 532, is the same as the maximum length of the first insertion portion 531, i.e., the diameter of the first insertion portion 531.

The second pin 54 protrudes toward the side with the openings 61 and 62, i.e., toward the left side, from the second opposing portion 52, and rotatably fits into the second groove 34 of the second mounting portion 32. The second pin 54 is provided with a second insertion portion 541 and a second fitting portion 542. The second insertion portion 541 is the right end portion of the second pin 54 and is inserted into the second hole 58 of the second opposing portion 52. The second fitting portion 542 is a portion that includes the right end portion of the second pin 54 and fits into the second groove 34 of the second mounting portion 32. The second fitting portion 542 of the second pin 54 protrudes in a cylindrical shape with a substantially constant diameter toward the left from the opposing surface 521 of the second opposing portion 52. The left end of the second pin 54, i.e., the left end of the second fitting portion 542, is farther to the right than the right end of the opening 62. No bumps and dips such as screw threads are formed on the outer periphery of the second pin 54. Instead, the outer periphery of the second pin 54 extends smoothly in direction M. The maximum length of the second fitting portion 542 in the radial direction orthogonal to direction M, i.e., the diameter of the second fitting portion 542, is the same as the maximum length of the second insertion portion 541, i.e., the diameter of the second insertion portion 541.

The first protruding portion 55 protrudes toward the side opposite the side with the openings 61 and 62, i.e., toward the left side, from the first opposing portion 51. The first protruding portion 55 protrudes toward the left from the gripping surface 512. A protrusion amount G1 of the first protruding portion 55 from the gripping surface 512 is smaller than a protrusion amount G2 of the first pin 53 from the opposing surface 511. The second protruding portion 56 protrudes from the second opposing portion 52 toward the side opposite the side with the openings 61 and 62, i.e., toward the right side. The second protruding portion 56 protrudes toward the right from the gripping surface 522. A protrusion amount G3 of the second protruding portion 56 from the gripping surface 522 is smaller than a protrusion amount G4 of the second pin 54 from the opposing surface 521. The lower end of the first protruding portion 55 and the lower end of the second protruding portion 56 are both positioned above the bottom surface 65 of the presser plate 50.

In direction N, an extension range D1 of the first protruding portion 55 overlaps with an extension range D2 of the first pin 53. The extension range D1 of the second protruding portion 56 overlaps with the extension range D2 of the second pin 54. In direction N, the extension range D1 of the first protruding portion 55 is the same as the extension range D1 of the second protruding portion 56. In direction N, the extension range D2 of the first pin 53 is the same as the extension range D2 of the second pin 54. The extension range D1 includes the extension range D2. The first protruding portion 55, the first pin 53, the second protruding portion 56, and the second pin 54 are all provided on the same straight line, e.g., on straight line E, that extends in direction M. The first pin 53 and the first protruding portion 55 of the present embodiment form a pin 59 having an integrally formed head portion, and the second pin 54 and the second protruding portion 56 form a pin 60 having an integrally formed head portion. The first protruding portion 55 is the head portion of the pin 59, and the first pin 53 is the shaft portion of the pin 59. The second protruding portion 56 is the head portion of the pin 60, and the second pin 54 is the shaft portion of the pin 60. The straight line E is an axial center common to the first protruding portion 55, the first pin 53, the second protruding portion 56, and the second pin 54 that extend in the left-right direction, for example. Although not shown in the drawings, fixing members such as washers for fixing the pins 59 and 60 to the first opposing portion 51 and the second opposing portion 52 are attached to the pins 59 and 60.

In the upper feed device 2 having the structure described above, when mounting the presser foot 5 to the main body portion 3 while the main body portion 3 of the upper feed device 2 is mounted to the lower end of the presser bar 21, the user arranges the presser foot 5 in a position on the needle plate 15 (refer to FIG. 1) in which the first pin 53 of the presser foot 5 is arranged below the first groove 33 of the first mounting portion 31 of the main body portion 3, and the second pin 54 of the presser foot 5 is arranged below the second groove 34 of the second mounting portion 32 of the main body portion 3, as shown in FIG. 2B. In FIG. 2B, for the sake of convenience in the description, the vertical distance between the main body portion 3 in a state in which the upper feed device 2 is mounted to the lower end of the presser bar 21, and the presser foot 5 mounted on the needle plate 15 is shown larger than it actually is. The user grabs the first protruding portion 55 and the second protruding portion 56 and moves the presser foot 5 upward. As a result, the first pin 53 of the presser foot 5 fits into the first groove 33 of the first mounting portion 31 of the main body portion 3, and the second pin 54 of the presser foot 5 fits into the second groove 34 of the second mounting portion 32 of the main body portion 3, as shown in FIG. 2A. The presser foot 5 is supported by the main body portion 3 so as to be able to pivot around the first pin 53 and the second pin 54, by the first pin 53 of the presser foot 5 being urged rearward by the urging member 41, and the second pin 54 of the presser foot 5 being urged rearward by the urging member 42.

As shown in FIG. 2A and FIG. 3B, in a state in which the presser foot 5 is mounted to the main body portion 3, the arm portion 301 of the upper feed dog 30 is inserted through the opening 61 from above, and the arm portion 302 of the upper feed dog 30 is inserted through the opening 62 from above. The first mounting portion 31 is arranged to the right of the opposing surface 511 of the first opposing portion 51. The right end of the first pin 53 protrudes slightly farther to the right than the right end of the first mounting portion 31, and is farther to the left than the left end of the arm portion 301. The second mounting portion 32 is arranged to the left of the opposing surface 521 of the second opposing portion 52. The left end of the second pin 54 protrudes slightly farther to the left than the left end of the second mounting portion 32, and is farther to the right than the right end of the arm portion 302.

Figures 4A, 4B:
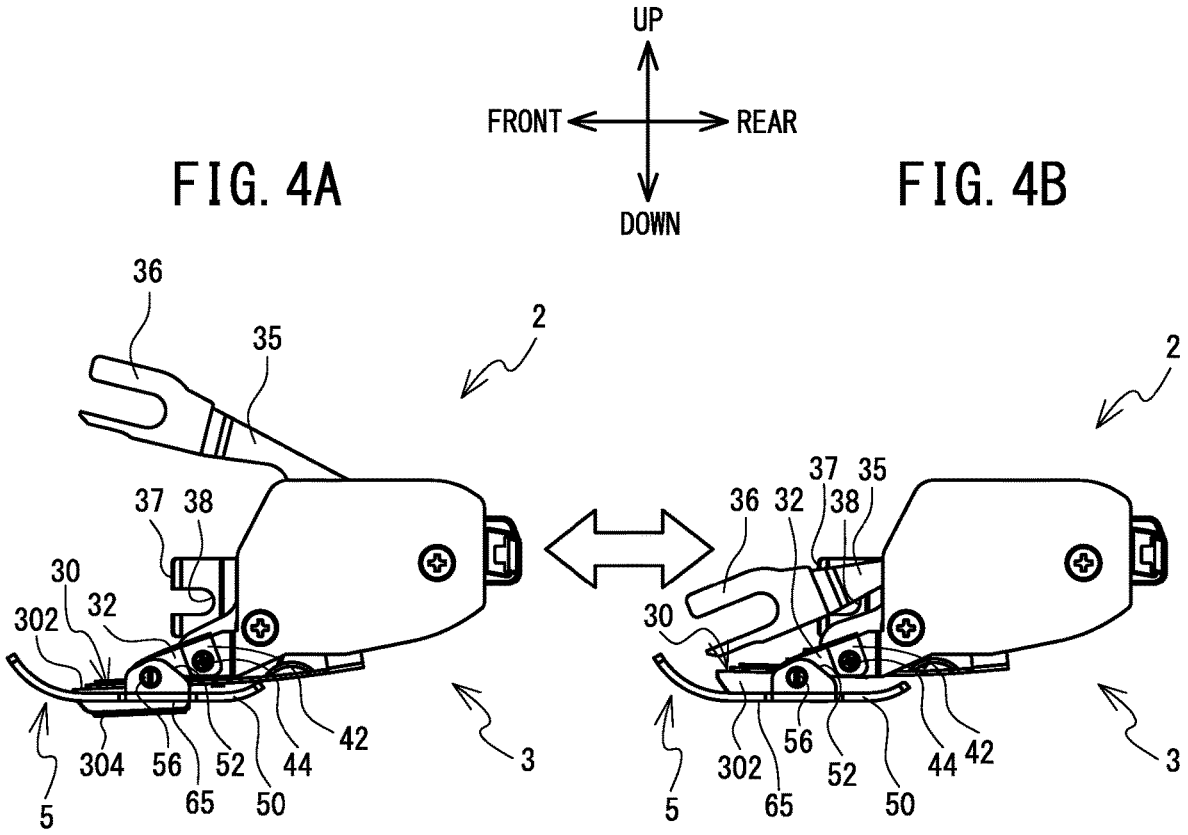
FIG. 4A is a right side view of the upper feed device when a needle bar is positioned at top dead center.
FIG. 4B is a right side view of the upper feed device when the needle bar is positioned at bottom dead center.

As shown in FIG. 4A, when the needle bar 20 is arranged at top-dead-center, the pivot lever 35 is positioned at the upper end of the pivot range, and the lower end of the upper feed dog 30, i.e., the plurality of teeth 303 and 304, are arranged below the bottom surface 65 of the presser foot 5. As a result, the presser foot 5 is vertically separated from the object to be sewn, while the upper feed dog 30, together with the feed dog 18, sends the object to be sewn in the conveyance direction, i.e., rearward. As shown in FIG. 4B, when the needle bar 20 is arranged at bottom-dead-center, the pivot lever 35 is positioned at the lower end of the pivot range, and the lower end of the upper feed dog 30 is arranged slightly above the bottom surface 65 of the presser foot 5 in the up-down direction. As a result, the upper feed dog 30 is vertically separated from the object to be sewn, while the presser foot 5 presses the object to be sewn toward the side with the needle plate 15 from above.

As shown in FIG. 2A, when detaching the presser foot 5 from the main body portion 3 while the upper feed device 2 is mounted to the lower end of the presser bar 21, the user separates the presser foot 5 from the needle plate 15 by arranging the presser bar 21 at the upper end within the movement range of the presser bar 21. The user then grabs the first protruding portion 55 and the second protruding portion 56 and moves the presser foot 5 downward. As a result, the first pin 53 of the presser foot 5 disengages from the first mounting portion 31 of the main body portion 3, and the second pin 54 of the presser foot 5 disengages from the second mounting portion 32 of the main body portion 3, thereby enabling the user to detach the presser foot 5 from the main body portion 3. As shown in FIG. 2B, in a state in which the presser foot 5 is detached from the main body portion 3 and the presser foot 5 is arranged on the needle plate 15, the lower end of the first mounting portion 31 is above the upper end of the first pin 53, and the lower end of the second mounting portion 32 is above the upper end of the second pin 54. Therefore, the user can remove the presser foot 5 that has been detached from the main body portion 3 from the needle plate 15 by sliding the presser foot 5 forward or rearward.

The presser foot 5 of the upper feed device 2 in this embodiment is provided with the first protruding portion 55 and the second protruding portion 56 that are arranged with the openings 61 and 62 between the first protruding portion 55 and the second protruding portion 56 in direction M. The user can fit the first pin 53 and the second pin 54 of the presser foot 5 into the first mounting portion 31 and the second mounting portion 32, respectively, of the main body portion 3 and mount the presser foot 5 to the main body portion 3 by grabbing the first protruding portion 55 and the second protruding portion 56 and lifting the presser foot 5 up. The user can disengage the first pin 53 and the second pin 54 of the presser foot 5 from the first mounting portion 31 and the second mounting portion 32 of the main body portion 3 and detach the presser foot 5 from the main body portion 3 by grabbing the first protruding portion 55 and the second protruding portion 56 and moving the presser foot 5 downward. Therefore, the upper feed device 2 enables the presser foot 5 to be replaced with respect to the main body portion 3 while the main body portion 3 remains mounted to the presser foot 5. Thus, the upper feed device 2 enables the operation of replacing the presser foot 5 to be simplified compared to a related device that requires the upper feed device 2 to be detached from the presser bar 21 of the sewing machine 1 when replacing the presser foot 5.

In direction N, the extension range D1 of the first protruding portion 55 overlaps with the extension range D2 of the first pin 53, and the extension range D1 of the second protruding portion 56 overlaps with the extension range D2 of the second pin 54. With the upper feed device 2, when the user grabs the first protruding portion 55 and the second protruding portion 56 and mounts the presser foot 5, the first protruding portion 55 and the second protruding portion 56 do not rotate easily with respect to the first pin 53 and the second pin 54. More specifically, when the user mounts the presser foot 5 to the main body portion 3, the first protruding portion 55 and the second protruding portion 56 that are grabbed by the user become points of effort, and the first pin 53 that abuts against the first groove 33 and the urging member 42 of the main body portion 3, and the second pin 54 that abuts against the second groove 34 and the urging member 42 of the main body portion 3 each become fulcrums. In direction N, the extension range D2 of the first pin 53 and the second pin 54 that are fulcrums overlap with the extension range D1 of the first protruding portion 55 and the second protruding portion 56 that are the points of effort, so the rotation of the first protruding portion 55 and the second protruding portion 56 with the first pin 53 and the second pin 54 as the fulcrums is inhibited. Therefore, with the upper feed device 2, the operations of attaching and detaching the presser foot 5 are easier than they are with a device in which the first protruding portion 55 and the second protruding portion 56 easily rotate with respect to the first pin 53 and the second pin 54.

The first protruding portion 55, the first pin 53, the second protruding portion 56, and the second pin 54 are provided on the same straight line E that extends in direction M. With the upper feed device 2, when the user grabs the first protruding portion 55 and the second protruding portion 56 and attaches or detaches the presser foot 5, the first protruding portion 55 and the second protruding portion 56 do not easily rotate with respect to the first pin 53 and the second pin 54. Therefore, with the upper feed device 2, the operations of attaching and detaching the presser foot 5 are easier than they are with a device in which the first protruding portion 55 and the second protruding portion 56, and the first pin 53 and the second pin 54 are not provided on the same straight line that extends in direction M.

The first hole 57 that passes through in direction M is formed in the first opposing portion 51. The first pin 53 and the first protruding portion 55 are integrally formed. The first pin 53 has the first insertion portion 531 that is inserted through the first hole 57, and the first fitting portion 532 that is configured to fit into the first groove 33. The second hole 58 that passes through in direction M is formed in the second opposing portion 52. The second pin 54 and the second protruding portion 56 are integrally formed. The second pin 54 has the second insertion portion 541 that is inserted through the second hole 58, and the second fitting portion 542 that is configured to fit into the second groove 34. With the upper feed device 2, the first pin 53 and the first protruding portion 55 can be accurately arranged with respect to the first opposing portion 51, and the second pin 54 and the second protruding portion 56 can be accurately arranged with respect to the second opposing portion 52, compared to a device in which the first pin 53 and the first protruding portion 55 are individually arranged with respect to the first opposing portion 51, and the second pin 54 and the second protruding portion 56 are individually arranged with respect to the second opposing portion 52.

The lower end of the first protruding portion 55 and the lower end of the second protruding portion 56 are both positioned above the bottom surface 65 of the presser plate 50. With the upper feed device 2, the user is able to easily grab the first protruding portion 55 and the second protruding portion 56 compared to a device in which the lower end of the first protruding portion 55 and the lower end of the second protruding portion 56 are both provided at the same height as the bottom surface 65 of the presser plate 50.

The main body portion 3 is provided with the urging member 41 that urges the first pin 53 fitted into the first groove 33 of the first mounting portion 31 in a direction orthogonal to the downward direction, and the urging member 42 that urges the second pin 54 fitted into the second groove 34 of the second mounting portion 32 in a direction orthogonal to the downward direction. The upper feed device 2 enables the first pin 53 and the second pin 54 to be stably kept in a state rotatably fitted into the first groove 33 and the second groove 34, respectively, by a comparatively simple structure.

Figure 5:
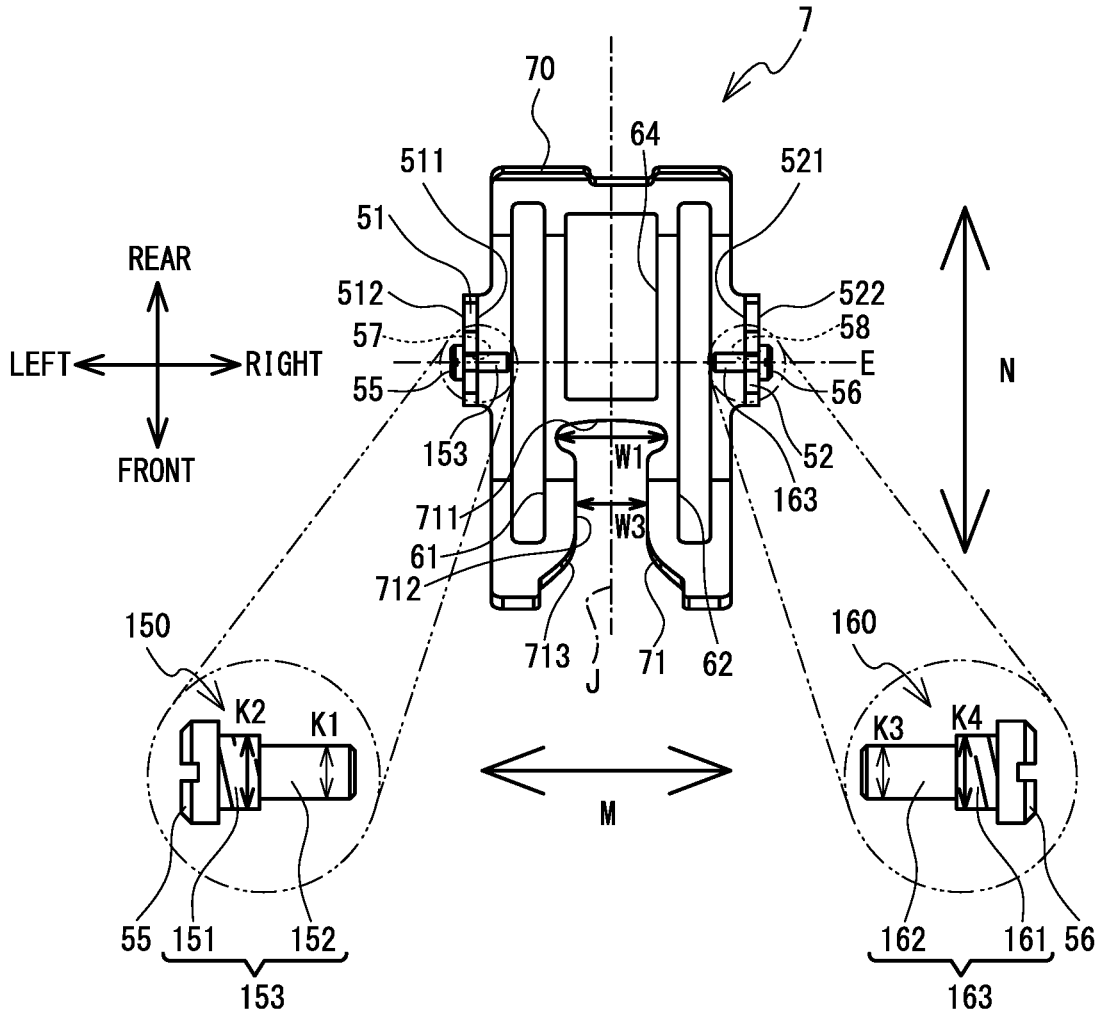
FIG. 5 is a plan view of a presser foot.

The presser foot 7 that is detachably mounted to the main body portion 3 of the upper feed device 2 will now be described with reference to FIG. 5. In FIG. 5, structure that is the same as the structure of the presser foot 5 will be denoted by the same reference characters. As shown in FIG. 5, the presser foot 7 differs from the presser foot 5 in that the presser foot 7 has a presser plate 70 instead of the presser plate 50 of the presser foot 5, the presser foot 7 is provided with a first pin 153 and a second pin 163 instead of the first pin 53 and the second pin 54, and the first hole 57 and the second hole 58 are screw holes. All other structure of the presser foot 7 is the same as that of the presser foot 5. The presser plate 70 has a cutout portion 71 instead of the cutout portion 63 of the presser plate 50. All of the other structure is the same as that of the presser plate 50. A description of the structure that is the same as that of the presser foot 5 will be omitted. Hereinafter, the cutout portion 71 that differs from the presser foot 5 will be described.

The presser foot 7 is an open toe presser foot, and the cutout portion 71 has a shape in which the front side of the needle hole is open to enable the needle drop position of the sewing needle 23 to be easily visible. The cutout portion 71 is a cutout formed in a T-shape when viewed from above, from the front end of the presser plate 70 toward the rear, in the center of the presser plate 70 in the left-right direction. The cutout portion 71 includes a rear end portion 711, a straight portion 712, and a front end portion 713. The rear end portion 711 is the same as the rear end portion 631, and extends in the left-right direction. The straight portion 712 extends in a straight line toward the front from the center of the rear end portion 711 in the left-right direction. The front end portion 713 is a portion that is connected to the front end portion of the straight portion 712, and is cut out such that the width in the left-right direction becomes shorter from the front end of the presser plate 70 toward the rear. The width W1 of the rear end portion 711 in the left-right direction is longer than the width W3 of the straight portion 712 in the left-right direction. More specifically, the width W3 of the straight portion 712 of the presser foot 7 is longer than the width W2 of the straight portion 632 of the presser foot 5, shown in FIG. 3A.

The first pin 153 and the first protruding portion 55 form a screw 150 that has an integrally formed head portion. The head portion of the screw 150 is the first protruding portion 55, and the shaft portion of the screw 150 is the first pin 153. The first pin 153 is provided with a first insertion portion 151 and a first fitting portion 152. The first insertion portion 151 is the left end portion of the first pin 153, and has a screw thread formed on the outer periphery. The first insertion portion 151 screws into the first hole 57 of the first opposing portion 51. The first fitting portion 152 is a portion that includes the right end portion of the first pin 153, and fits into the first groove 33 of the first mounting portion 31. The first fitting portion 152 of the first pin 153 protrudes in a cylindrical shape with a substantially constant diameter toward the right from the opposing surface 511 of the first opposing portion 51. The right end of the first pin 153, i.e., the right end of the first fitting portion 152, is farther to the left than the left end of the opening 61. No bumps and dips such as screw threads are formed on the outer periphery of the first fitting portion 152. Instead, the outer periphery of the first fitting portion 152 extends smoothly in direction M. The maximum length of the first insertion portion 151 in the radial direction orthogonal to direction M, i.e., the outer diameter of the first insertion portion 151, is longer than the maximum length of the first fitting portion 152, i.e., the diameter of the first fitting portion 152. The second pin 163 and the second protruding portion 56 form a screw 160 having an integrally formed head portion. The head portion of the screw 160 is the second protruding portion 56, and the shaft portion of the screw 160 is the second pin 163. The screw 160 has the same shape as the screw 150. The second pin 163 is provided with a second insertion portion 161 and a second fitting portion 162. The second insertion portion 161 is the right end portion of the second pin 163, and has a screw thread formed on the outer periphery. The second insertion portion 161 screws into the second hole 58 of the second opposing portion 52. The second fitting portion 162 is a portion that includes the left end portion of the second pin 163, and fits into the second groove 34 of the second mounting portion 32.

In the embodiment described above, with the presser foot 7, the first hole 57 and the second hole 58 are both screw holes, and the first insertion portion 151 and the second insertion portion 161 both have a screw thread that screws into the screw holes, respectively. The first protruding portion 55 is the head portion of the screw 150, and the second protruding portion 56 is the head portion of the screw 160. Therefore, with the upper feed device 2 having the presser foot 7, the first pin 153 and the first protruding portion 55 can be provided on the first opposing portion 51, and the second pin 163 and the second protruding portion 56 can be provided on the second opposing portion 52, through the simple process of screwing the first insertion portion 151 into the first hole 57 and screwing the second insertion portion 161 into the second hole 58.

With the presser foot 7, the maximum length K1 of the first fitting portion 152 in the radial direction orthogonal to direction M is shorter than the maximum length K2 of the first insertion portion 151 in the radial direction. The maximum length K3 of the second fitting portion 162 in the radial direction is shorter than the maximum length K4 of the second insertion portion 161. The first insertion portion 151 having a larger maximum length in the radial direction than the first fitting portion 152 is inserted through the first hole 57 of the first opposing portion 51, so the first pin 153 can be fixed to the first opposing portion 51 more strongly than when the first insertion portion 151 having a maximum length in the radial direction that is the same as or smaller than that of the first fitting portion 152 is inserted through the first hole 57 of the first opposing portion 51. The second insertion portion 161 having a larger maximum length in the radial direction than the second fitting portion 162 is inserted through the second hole 58 of the second opposing portion 52, so the second pin 54 can be fixed to the second opposing portion 52 more strongly than when the second insertion portion 161 having a maximum length in the radial direction that is equal to or smaller than that of the second fitting portion 162 is inserted through the second hole 58 of the second opposing portion 52.

Figure 6:
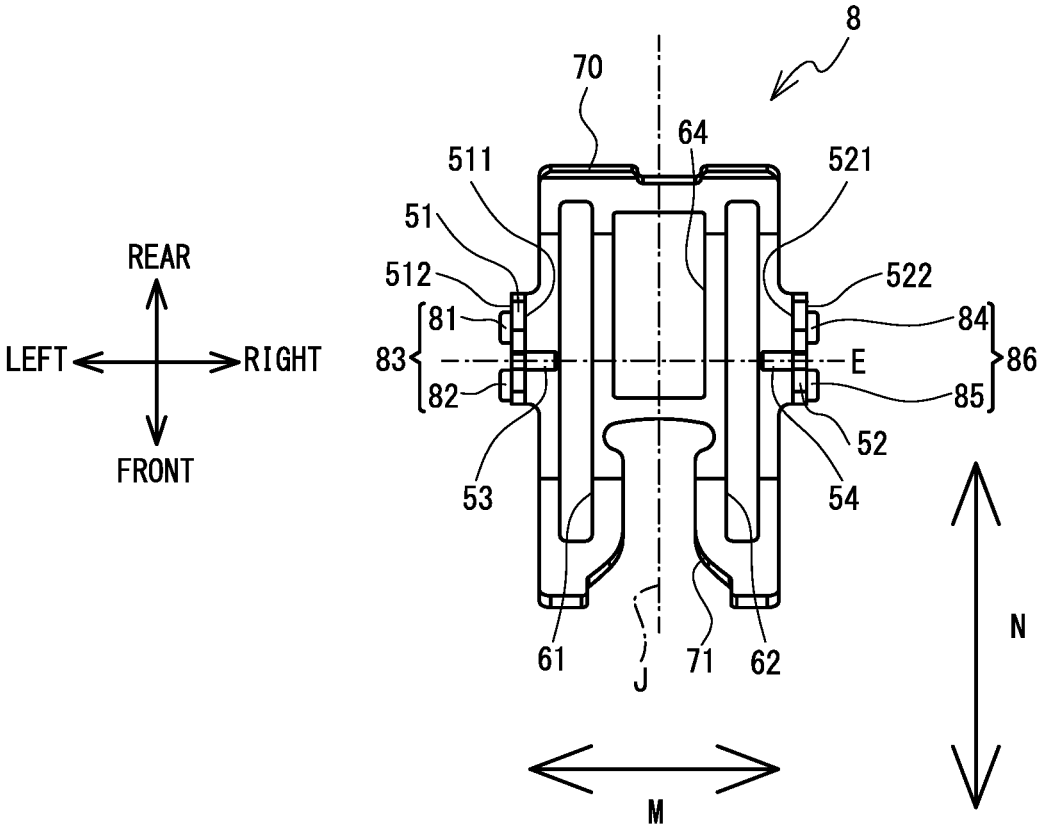
FIG. 6 is a plan view of a presser foot.

A presser foot 8 that is detachably mounted to the main body portion 3 of the upper feed device 2 will now be described with reference to FIG. 6. In FIG. 6, structure that is the same as that of the presser foot 5 (refer to FIG. 3) and the presser foot 7 (refer to FIG. 5) will be denoted by the same reference characters. As shown in FIG. 6, the presser foot 8 differs from the presser foot 5 in that the presser foot 8 has the same presser plate 70 as the presser foot 7 instead of the presser plate 50 of the presser foot 5, and is provided with a first protruding portion 83 and a second protruding portion 86 instead of the first protruding portion 55 and the second protruding portion 56 of the presser foot 5. All other structure is the same as that of the presser foot 5. Descriptions of structure that is the same as that of the presser feet 5 and 7 will be omitted. Hereinafter, the first protruding portion 83 and the second protruding portion 86, which differ from the presser feet 5 and 7, will be described.

The first protruding portion 83 has first protrusions 81 and 82 arranged with the first pin 53 between the first protrusions 81 and 82 in direction N. The first protrusion 81 protrudes toward the left from the gripping surface 512 of the first opposing portion 51 at a position to the rear side of the first pin 53 in the front-rear direction. The first protrusion 82 protrudes toward the left from the gripping surface 512 of the first opposing portion 51 at a position in the front side of the first pin 53 in the front-rear direction. The extension range of the first pin 53 and the extension range of both first protrusions 81 and 82 do not overlap with each other in direction N. The first protrusions 81 and 82 are formed separately from the first pin 53. The second protruding portion 86 has a structure symmetrical to the first protruding portion 83, and the second protruding portion 86 has second protrusions 84 and 85 arranged with the second pin 54 between the second protrusions 84 and 85 in direction N. The lower ends of the first protruding portion 83 and the second protruding portion 86 are positioned above the bottom surface of the presser plate 70.

The first protruding portion 83 has the first protrusions 81 and 82 with the first pin 53 between the first protrusions 81 and 82 in direction N. The second protruding portion 86 has the second protrusions 84 and 85 with the second pin 54 between the second protrusions 84 and 85 in direction N. With the upper feed device 2 having the presser foot 8, the first protruding portion 83 and the second protruding portion 86 do not easily rotate with respect to the first pin 53 and the second pin 54 when the user grabs the first protruding portion 83 and the second protruding portion 86 and mounts the presser foot 8. More specifically, when the user mounts the presser foot 8, the first protrusions 81 and 82 and the second protrusions 84 and 85 that are grabbed by the user become points of effort, and the first pin 53 that abuts against the first groove 33 and the urging member 41 of the main body portion 3, and the second pin 54 that abuts against the second groove 34 and the urging member 42 of the main body portion 3 each become fulcrums. In direction N, the extension range D2 of the first pin 53 that is a fulcrum is within the extension range of the first protrusions 81 and 82 that are points of effort, and the extension range D2 of the second pin 54 that is a fulcrum is within the extension range of the second protrusions 84 and 85 that are points of effort. Therefore, rotation of the first protruding portion 83 and the second protruding portion 86 with the first pin 53 and the second pin 54 as fulcrums is inhibited. As a result, with the upper feed device 2, the operations of attaching and detaching the presser foot 8 are easier than they are with a device in which the first pin 53 and the second pin 54 easily rotate with respect to the first protruding portion 83 and the second protruding portion 86.

Figure 7:
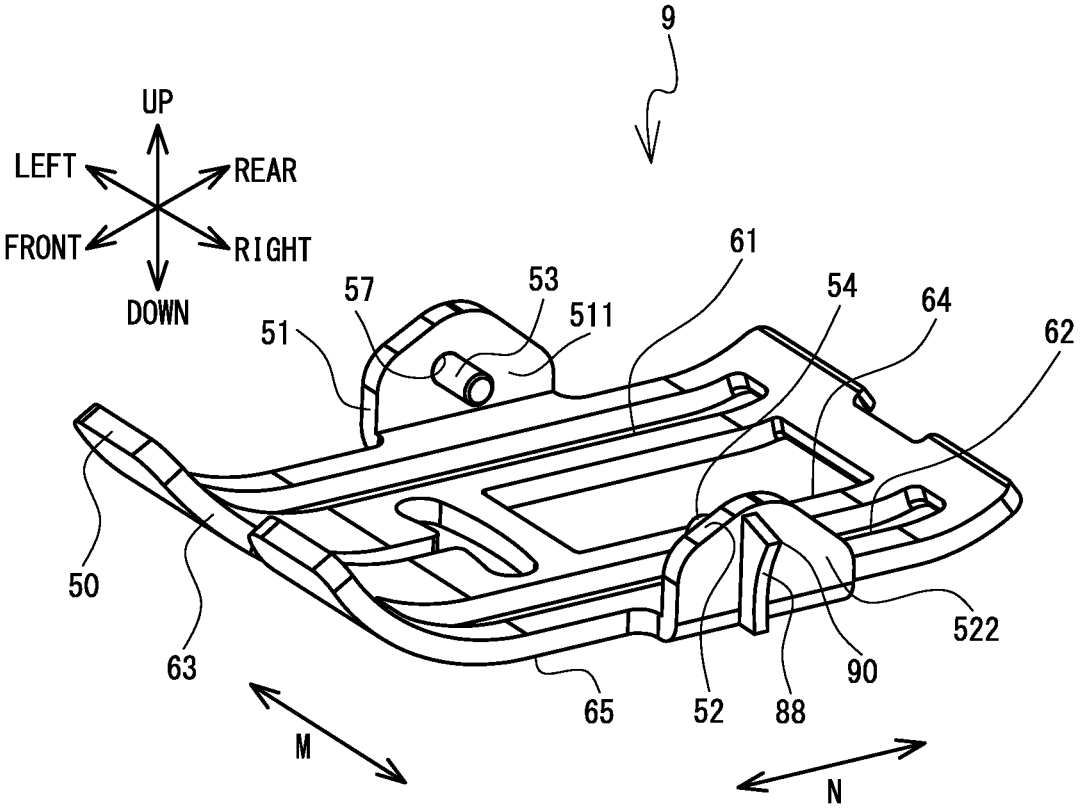
FIG. 7 is a perspective view of a presser foot.
Figure 8:
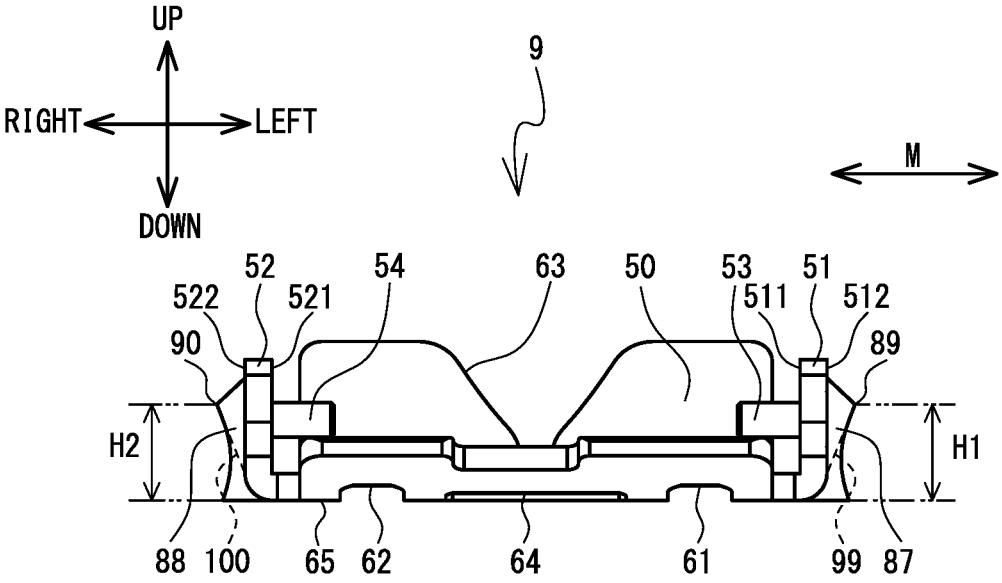
FIG. 8 is a back view of the presser foot.

A presser foot 9 that is detachably mounted to the main body portion 3 of the upper feed device 2 will be described with reference to FIG. 7 and FIG. 8. In FIG. 7 and FIG. 8, structure that is the same as that of the presser foot 5 will be denoted by the same reference characters. As shown in FIG. 7 and FIG. 8, the presser foot 9 differs from the presser foot 5 in that the presser foot 9 is provided with a first protruding portion 87 and a second protruding portion 88 instead of the first protruding portion 55 and the second protruding portion 56 of the presser foot 5. All other structure is the same as that of the presser foot 5. A description of the structure that is the same as that of the presser foot 5 will be omitted. Hereinafter, the first protruding portion 87 and the second protruding portion 88 that differ from the presser foot 5 will be described.

As shown in FIG. 8, the first protruding portion 87 protrudes toward the side opposite the side with the openings 61 and 62, i.e., toward the left side, from the first opposing portion 51. The extension range of the first pin 53 and the extension range of the first protruding portion 87 overlap with each other in the up-down direction. A first portion 89 of the first protruding portion 87 that protrudes farthest toward the side opposite the side with the openings 61 and 62, i.e., toward the left side, from the first opposing portion 51 is positioned above the upper end of the first pin 53. The protrusion amount of the first protruding portion 87 from the gripping surface 512 of the first opposing portion 51 decreases farther upward above the first portion 89. The portion below the first portion 89 of the first protruding portion 87 curves in an arc shape so as to form a protrusion toward the right when viewed from the rear. The lower end portion of the first protruding portion 87 protrudes toward the left from the gripping surface 512 and is flush with the bottom surface 65 of the presser foot 9. The extension range of the first pin 53 and the extension range of the first protruding portion 87 overlap with each other in direction N. The first protruding portion 87 is formed separately from the first pin 53. The second protruding portion 88 has a structure symmetrical to the first protruding portion 87, so the description thereof will be simplified. As shown in FIG. 7 and FIG. 8, the second protruding portion 88 protrudes toward the side opposite the side with the openings 61 and 62, i.e., toward the right side, from the second opposing portion 52. A second portion 90 of the second protruding portion 88 that protrudes farthest toward the side opposite the side with the openings 61 and 62, i.e., toward the right side, from the second opposing portion 52 is positioned above the bottom surface 65 of the presser plate 50. The height H1 from the bottom surface 65 of the presser plate 50 to the first portion 89 is equal to the height H2 from bottom surface 65 of the presser plate 50 to the second portion 90.

In the embodiment described above, with the presser foot 9, the first portion 89 of the first protruding portion 87 that protrudes farthest toward the side opposite the side with the openings 61 and 62 from the first opposing portion 51, and the second portion 90 of the second protruding portion 88 that protrudes farthest toward the side opposite the side with the openings 61 and 62 from the second opposing portion 52, are both positioned above the bottom surface 65 of the presser plate 50. With the upper feed device 2 having the presser foot 9, the user can grab the first protruding portion 87 and the second protruding portion 88 more easily than with a device in which the first portion 89 of the first protruding portion 87 and the second portion 90 of the second protruding portion 88 are provided at the same height as the bottom surface 65 of the presser plate 50. The shapes of the first protruding portion 87 and the second protruding portion 88 may be modified as appropriate. For example, the lower end of the first protruding portion 87 may be identical to the lower end portion of the gripping surface 512 of the first opposing portion 51, as shown by the virtual line 99, and the lower end of the second protruding portion 88 may be identical to the lower end portion of the gripping surface 522 of the second opposing portion 52, as shown by the virtual line 100.

Figures 9A, 9B:
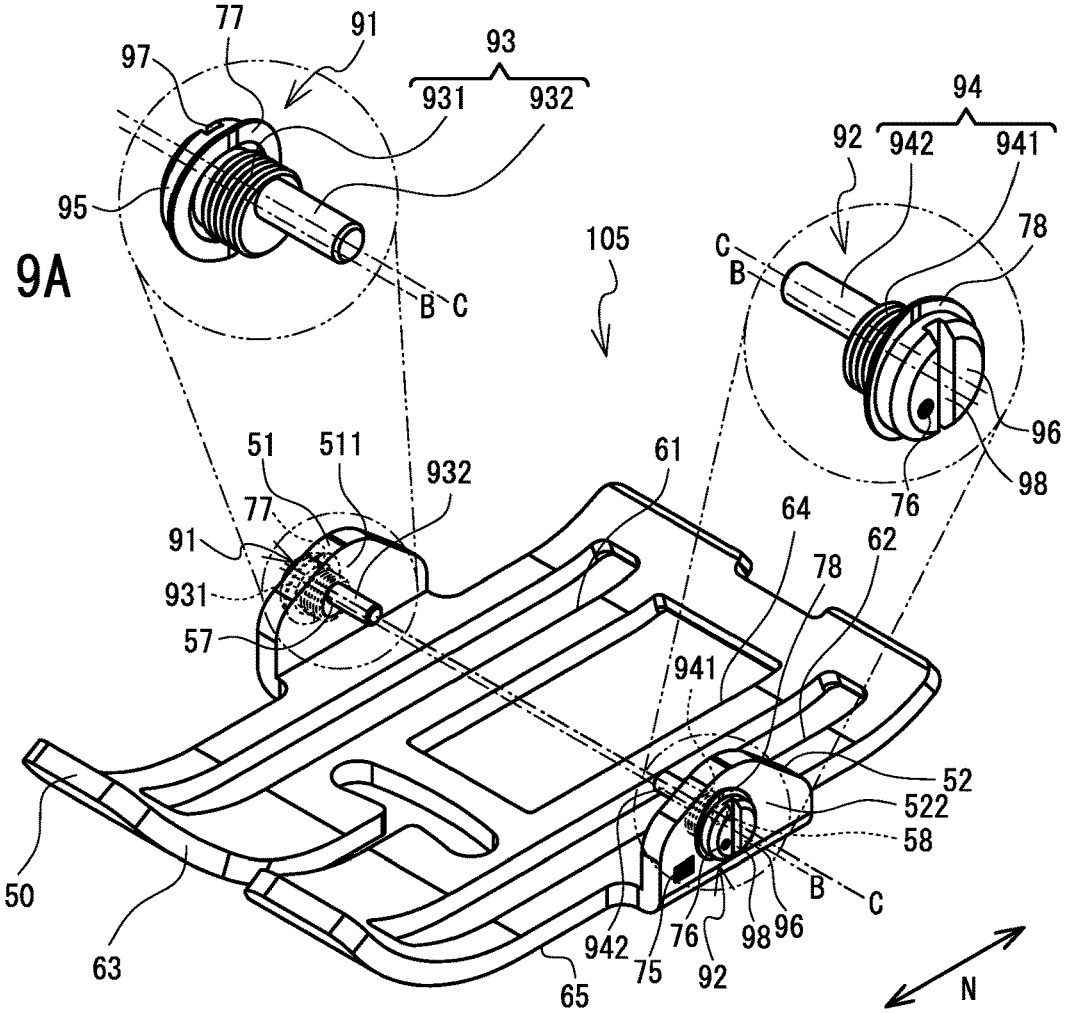
FIG. 9A is a perspective view of a presser foot in which the axial centers of a first fitting portion and a second fitting portion are arranged above the axial centers of a first insertion portion and a second insertion portion.
FIG. 9B is a perspective view of the presser foot in which the axial centers of the first fitting portion and the second fitting portion are arranged below the axial centers of the first insertion portion and the second insertion portion.

A presser foot 105 that is detachably mounted to the main body portion 3 of the upper feed device 2 will now be described with reference to FIG. 9 and FIG. 10. In FIG. 9 and FIG. 10, structure that is the same as the structure of the presser foot 5 (refer to FIG. 3) will be denoted by the same reference characters. As shown in FIG. 9 and FIG. 10, the presser foot 105 differs from the presser foot 5 in that the presser foot 105 has a first pin 93 and a first protruding portion 95 instead of the first pin 53 and the first protruding portion 55 of the presser foot 5, and has a second pin 94 and a second protruding portion 96 instead of the second pin 54 and the second protruding portion 56 of the presser foot 5, and in that the first hole 57 and the second hole 58 are screw holes. The presser foot 105 also differs from the presser foot 5 in that a marker 75 having a rectangular shape that is long in the front-rear direction is drawn on the right side of the second opposing portion 52, and a marker, not shown, that is the same as the marker 75 is drawn on the left side of the first opposing portion 51. All other structure of the presser foot 105 is the same as that of the presser foot 5. A description of the structure that is the same as that of the presser foot 5 will be omitted. Hereinafter, the first pin 93, the first protruding portion 95, the second pin 94, and the second protruding portion 96, which differ from the presser foot 5, will be described.

The first pin 93 and the first protruding portion 95 form an integrally formed eccentric screw 91. The first pin 93 is an eccentric shaft portion of the eccentric screw 91, and includes a first insertion portion 931 and a first fitting portion 932. The first insertion portion 931 is the left end portion of the first pin 93 and is inserted into the first hole 57 of the first opposing portion 51. A screw thread is formed on the outer periphery of the first insertion portion 931, and the first insertion portion 931 screws into the first hole 57. The first fitting portion 932 is a portion that includes the right end portion of the first pin 93 and fits into the first groove 33 of the first mounting portion 31. The first fitting portion 932 has a cylindrical shape that is long in the left-right direction and has a substantially constant diameter. No bumps and dips such as screw threads are formed on the outer periphery of the first fitting portion 932. Therefore, the outer periphery of the first fitting portion 932 extends smoothly in direction M. The maximum length of the first fitting portion 932 in the radial direction orthogonal to direction M, i.e., the diameter of the first fitting portion 932, is shorter than the maximum length of the first insertion portion 931, i.e., the outer diameter of the first insertion portion 931. The axial center B of the first insertion portion 931 that extends in direction M is different from the axial center C of the first fitting portion 932 that extends in direction M. The first protruding portion 95 is the head portion of the eccentric screw 91, and has a disk shape that connects to the left end of the first insertion portion 931. A groove portion 97 that extends in a straight line in the radial direction and is recessed to the right is formed in the left surface of the first protruding portion 95. An elastic member 77 fits over the eccentric screw 91. The elastic member 77 is a ring-shaped plate spring which inhibits the eccentric screw 91 from rotating with respect to the first opposing portion 51 by urging the first protruding portion 95 to the left.

The second pin 94 and the second protruding portion 96 have structures that are symmetrical to the first pin 93 and the first protruding portion 95, respectively. The second pin 94 and the second protruding portion 96 form an integrally formed eccentric screw 92. The second pin 94 has a second insertion portion 941 and a second fitting portion 942. The second insertion portion 941 is the right end portion of the second pin 94, and is inserted into the second hole 58 of the second opposing portion 52. A screw thread is formed on the outer periphery of the second insertion portion 941, and the second insertion portion 941 screws into the second hole 58. The second fitting portion 942 is a portion that includes the left end portion of the second pin 94 and fits into the second groove 34 of the second mounting portion 32. The maximum length of the second fitting portion 942 in the radial direction orthogonal to direction M is shorter than the maximum length of the second insertion portion 941. The axial center B of the second insertion portion 941 that extends in direction M is different from the axial center C of the second fitting portion 942 that extends in direction M. The second protruding portion 96 is the head portion of the eccentric screw 92, and has a disk shape that connects to the left end of the second insertion portion 941. A groove portion 98 that extends in a straight line in the radial direction and is recessed to the left is formed in the right surface of the second protruding portion 96. The lower end of the first protruding portion 95 and the lower end of the second protruding portion 96 are positioned above the bottom surface 65 of the presser plate 50. An elastic member 78 fits over the eccentric screw 92. The elastic member 78 is a ring-shaped plate spring which inhibits the eccentric screw 92 from rotating with respect to the second opposing portion 52 by urging the second protruding portion 96 to the right. A black circular marker 76 in a right side view is drawn on the right side of the second protruding portion 96. Although not shown in the drawings, a black circular marker in a left side view, similar to the marker 76, is drawn on the left side of the first protruding portion 95.

The user can change the height of the first fitting portion 932 from the bottom surface 65 of the presser foot 105 by rotating the eccentric screw 91 using a tool such as a screwdriver that engages with the groove portion 97. The user can also change the height of the second fitting portion 942 from the bottom surface 65 of the presser foot 105 by rotating the eccentric screw 92 using a tool such as a screwdriver that engages with the groove portion 98. As a result, with the presser foot 105, it is possible to change the maximum protrusion amount of the upper feed dog 30 from the bottom surface 65 of the presser foot 105 when the presser foot 105 is mounted to the main body portion 3 and used with the sewing machine 1.

Figure 10A:
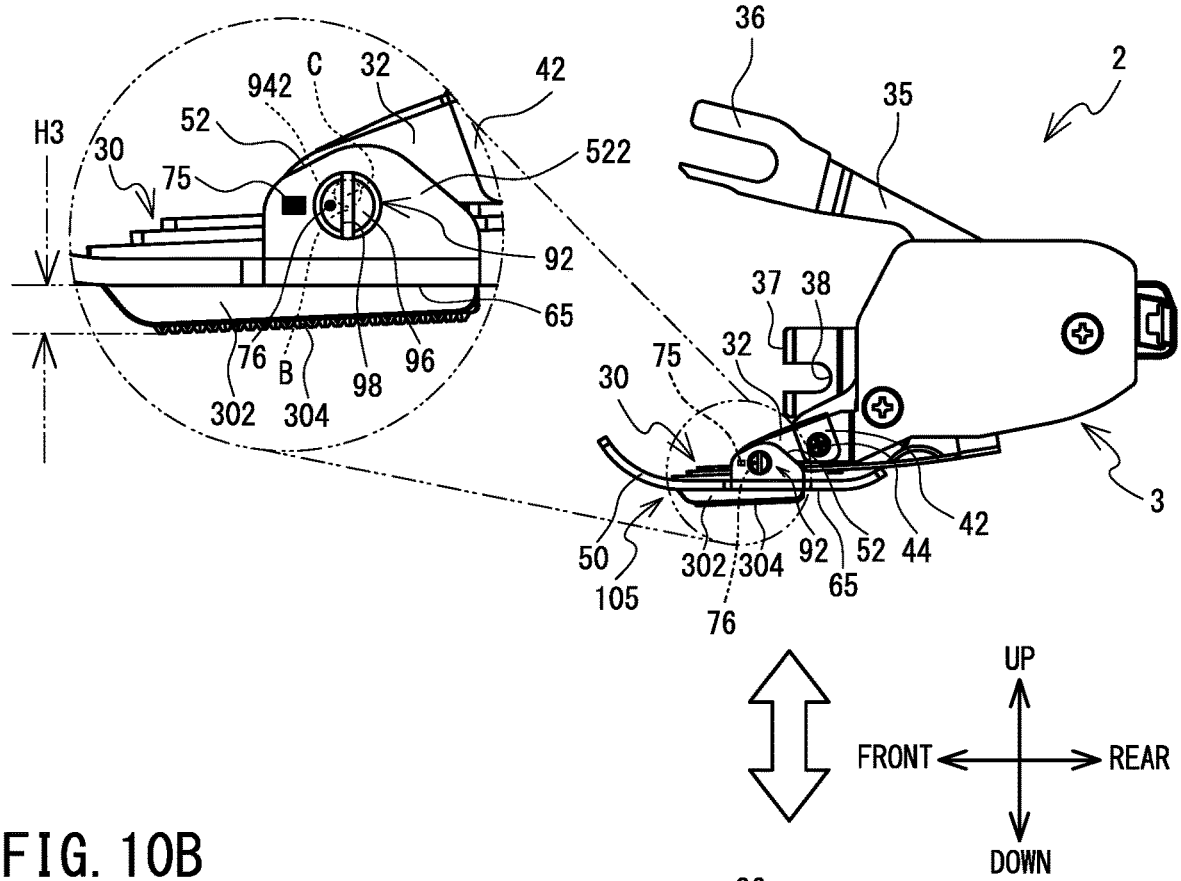
FIG. 10A is a right side view of the presser foot in which the axial centers of the first fitting portion and the second fitting portion are arranged above the axial centers of the first insertion portion and the second insertion portion.
Figure 10B:
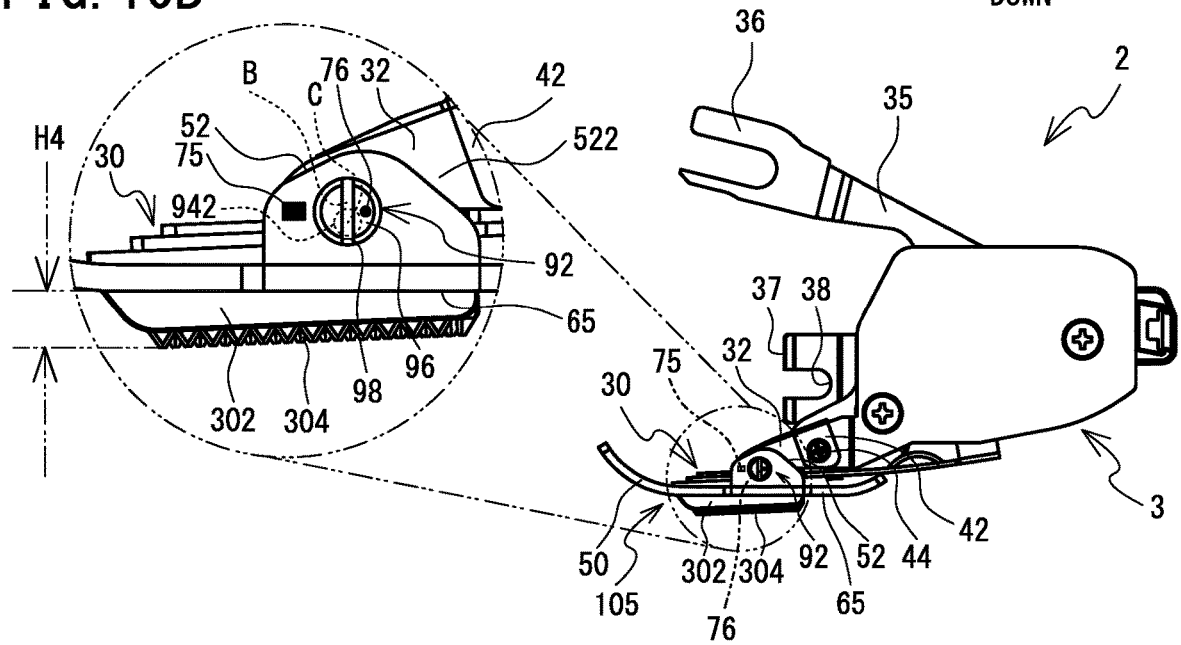
FIG. 10B is a right side view of the presser foot in which the axial centers of the first fitting portion and the second fitting portion are arranged below the axial centers of the first insertion portion and the second insertion portion.

FIG. 10A shows a state in which the axial center C of the first fitting portion 932 is arranged above the axial center B of the first insertion portion 931 of the eccentric screw 91, and the axial center C of the second fitting portion 942 is arranged above the axial center B of the second insertion portion 941 of the eccentric screw 92. In the state shown in FIG. 10A, the groove portion 98 of the second protruding portion 96 extends in the up-down direction, and the marker 76 drawn on the second protruding portion 96 is positioned on the side of the groove portion 98 with the marker 75 drawn on the second opposing portion 52, i.e., on the front side of the groove portion 98. The vertical position of the marker 76 is substantially the same as the vertical position of the marker 75. FIG. 10B shows a state in which the axial center C of the first fitting portion 932 is arranged below the axial center B of the first insertion portion 931 of the eccentric screw 91, and the axial center C of the second fitting portion 942 is arranged below the axial center B of the second insertion portion 941 of the eccentric screw 92. In the state shown in FIG. 10B, the groove portion 98 of the second protruding portion 96 extends in the up-down direction, and the marker 76 drawn on the second protruding portion 96 is positioned on the side of the groove portion 98 that is opposite the side with the marker 75 that is drawn on the second opposing portion 52, i.e., on the side of the groove portion 98. The vertical position of the marker 76 is substantially the same as the vertical position of the marker 75. Both FIG. 10A and FIG. 10B correspond to a case in which the upper feed device 2 is mounted to the lower end of the presser bar 21 (refer to FIG. 1), and the needle bar 20 (refer to FIG. 1) is positioned at top-dead-center. The maximum protrusion amount H3 of the upper feed dog 30 from the bottom surface 65 in the case of FIG. 10A is smaller than the maximum protrusion amount H4 of the upper feed dog 30 from the bottom surface 65 in the case of FIG. 10B.

In the embodiment described above, with the presser foot 105, the axial center B of the first insertion portion 931 that extends in direction M is different from the axial center C of the first fitting portion 932 that extends in direction M. The axial center B of the second insertion portion 941 that extends in direction M is different from the axial center C of the second fitting portion 942 that extends in direction M. With the upper feed device 2 provided with the presser foot 105, the length from the bottom surface 65 of the presser foot 105 to the first fitting portion 932 and the second fitting portion 942 can be adjusted by changing the position of the axial center C of the first fitting portion 932 with respect to the axial center B of the first insertion portion 931, and changing the position of the axial center C of the second fitting portion 942 with respect to the axial center B of the second insertion portion 941. Therefore, with the upper feed device 2, the user can change the maximum protrusion amount of the upper feed dog 30 that protrudes below the bottom surface 65 of the presser foot 105 by changing the length from the bottom surface 65 of the presser foot 105 to the first fitting portion 932 and the second fitting portion 942 in accordance with the thickness and material, etc., of the object to be sewn. The user can easily adjust the height of the second fitting portion 942 from the bottom surface 65 of the presser foot 105 using the marker 76 drawn on the second protruding portion 96 and the marker 75 drawn on the right side surface of the second opposing portion 52 as markers. The same also applies when adjusting the height of the first fitting portion 932 from the bottom surface 65 of the presser foot 105. Markers such as the markers 75 and 76 drawn on the presser foot 105 may be omitted or the shapes and/or arrangement and the like thereof may be modified.

Figure 11A:
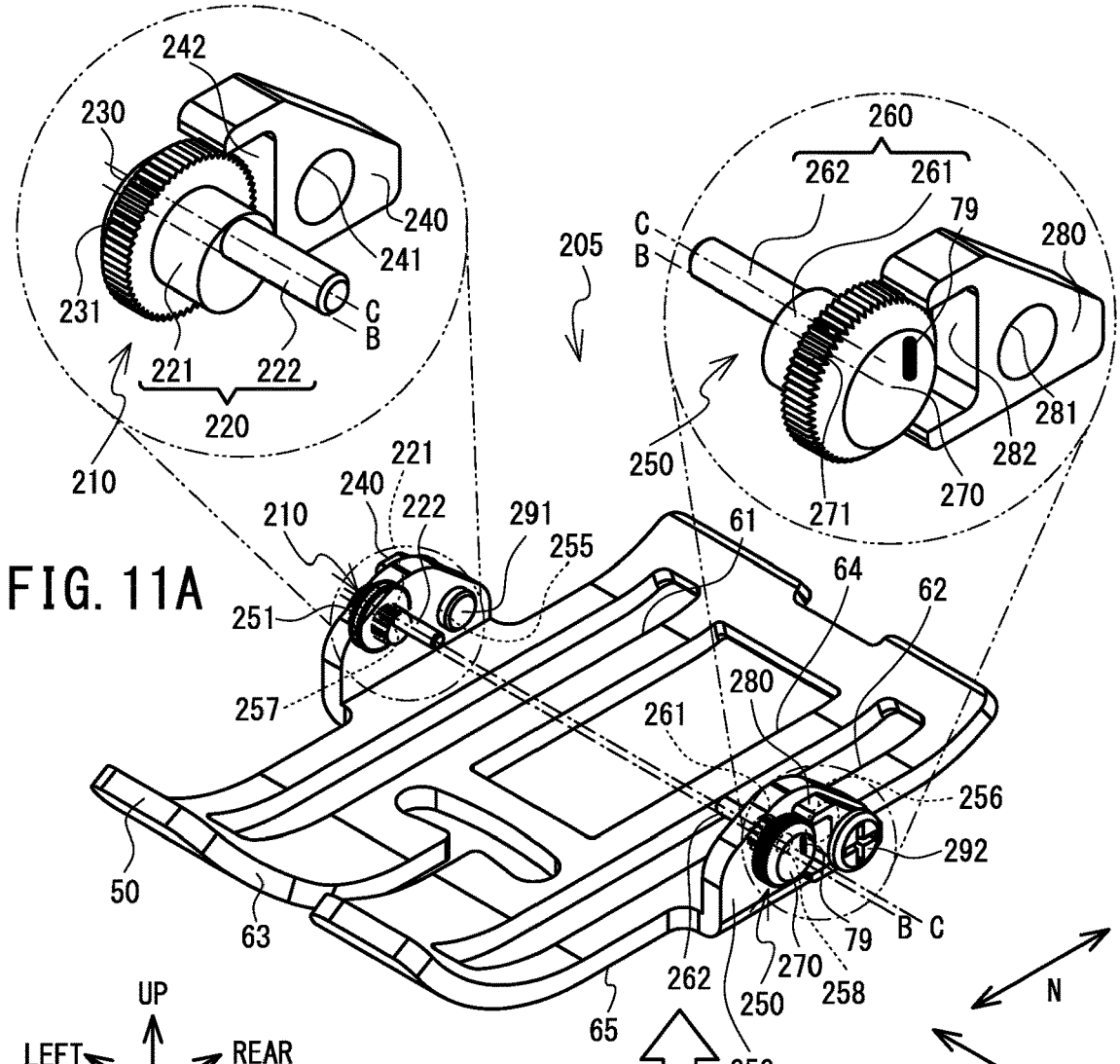
FIG. 11A is a perspective view of a presser foot in which the axial centers of a first fitting portion and a second fitting portion are arranged above the axial centers of a first insertion portion and a second insertion portion.
Figure 11B:
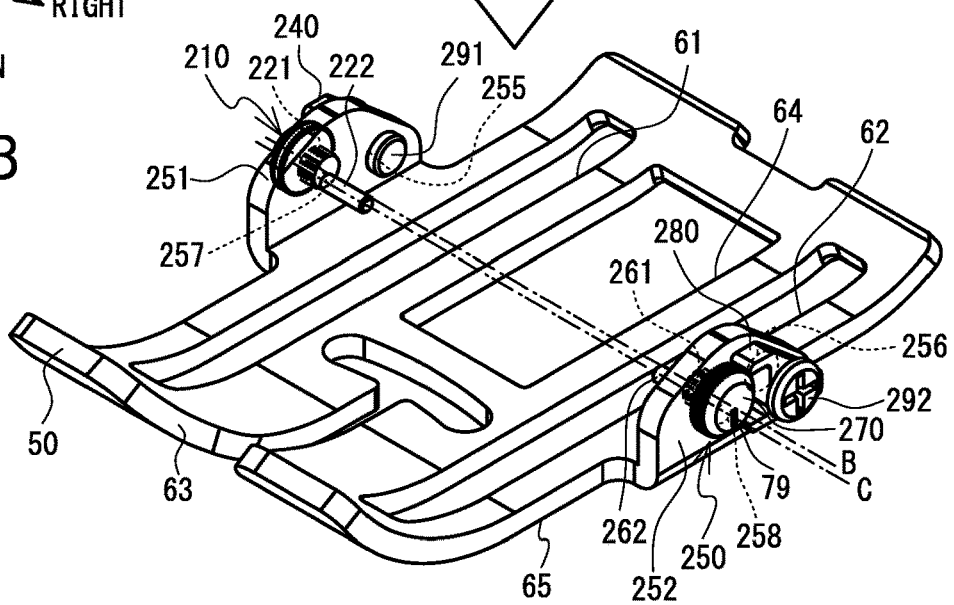
FIG. 11B is a perspective view of the presser foot in which the axial centers of the first fitting portion and the second fitting portion are arranged below the axial centers of the first insertion portion and the second insertion portion.

A presser foot 205 that is detachably mounted to the main body portion 3 of the upper feed device 2 will now be described with reference to FIG. 11. In FIG. 11, structure that is the same as the structure of the presser foot 5 (refer to FIG. 3) will be denoted by the same reference characters. As shown in FIG. 11, the presser foot 205 differs from the presser foot 5 in that the presser foot 205 has a first pin 220 and a first protruding portion 230 instead of the first pin 53 and the first protruding portion 55 of the presser foot 5, and has a second pin 260 and a second protruding portion 270 instead of the second pin 54 and the second protruding portion 56 of the presser foot 5. The presser foot 205 also differs from the presser foot 5 in that the presser foot 205 has a first opposing portion 251 instead of the first opposing portion 51 of the presser foot 5, and has a second opposing portion 252 instead of the second opposing portion 52 of the presser foot 5. The presser foot 205 also differs from the presser foot 5 in that the presser foot 205 has positioning plates 240 and 280. All other structure of the presser foot 205 is the same as that of the presser foot 5. A description of the structure that is the same as that of the presser foot 5 will be omitted. Hereinafter, the first opposing portion 251, the second opposing portion 252, the first pin 220, the first protruding portion 230, the second pin 260, the second protruding portion 270, and the positioning plates 240 and 280, which differ from the presser foot 5, will be described.

The first opposing portion 251 extends upward from the presser plate 50 on one side, i.e., the left side, of the openings 61 and 62 in direction M. A first hole 257 and a fixing hole 255 that pass through in direction M are formed in the first opposing portion 251. The lower ends of the first hole 257 and the fixing hole 255 are positioned above the bottom surface 65 of the presser plate 50. The first hole 257 is formed in the front side of the fixing hole 255. The second opposing portion 252 extends upward from the presser plate 50 on the other side, i.e., the right side, of the openings 61 and 62 in direction M, and faces the first opposing portion 251. A second hole 258 and a fixing hole 256 that pass through in direction M are formed in the second opposing portion 252. The lower ends of the second hole 258 and the fixing hole 256 are positioned above the bottom surface 65 of the presser plate 50. The second hole 258 is formed in the front side of the fixing hole 256.

The first pin 220 and the first protruding portion 230 form an eccentric pin 210 that has an integrally formed head. The first pin 220 is provided with a first insertion portion 221 and a first fitting portion 222. The first insertion portion 221 is the left end portion of the first pin 220 and is inserted into the first hole 257 of the first opposing portion 251. The first fitting portion 222 is a portion that includes the right end portion of the first pin 220 and fits into the first groove 33 of the first mounting portion 31. The first insertion portion 221 and the first fitting portion 222 both have a cylindrical shape that is long in the left-right direction and no bumps and dips such as screw threads are formed on the outer periphery of either the first insertion portion 221 or the first fitting portion 222. Therefore, the outer peripheries of the first insertion portion 221 and the first fitting portion 222 extend smoothly in direction M. The maximum length of the first fitting portion 222 in the radial direction orthogonal to direction M is shorter than the maximum length of the first insertion portion 221. The axial center B of the first insertion portion 221 that extends in direction M is different from the axial center C of the first fitting portion 222 that extends in direction M. The first protruding portion 230 has a disk shape that connects to the left end of the first insertion portion 221 and has an axial center that is the same as the axial center B of the first insertion portion 221. A plurality of recessed portions 231, i.e., notches, that extend parallel to the axial center B are formed at equally spaced intervals on the outer periphery of the first protruding portion 230.

The second pin 260 and the second protruding portion 270 have structures that are symmetrical to the first pin 220 and the first protruding portion 230, respectively, so descriptions thereof will be simplified. The second pin 260 and the second protruding portion 270 form an integrally formed eccentric pin 250. The second pin 260 has a second insertion portion 261 and a second fitting portion 262. The second insertion portion 261 is the right end portion of the second pin 260, and is inserted into the second hole 258 of the second opposing portion 252. The second fitting portion 262 is a portion that includes the left end portion of the second pin 260 and fits into the second groove 34 of the second mounting portion 32. The maximum length of the second fitting portion 262 in the radial direction orthogonal to direction M is shorter than the maximum length of the second insertion portion 261. The axial center B of the second insertion portion 261 that extends in direction M is different from the axial center C of the second fitting portion 262 that extends in direction M. The second protruding portion 270 has a disk shape that connects to the right end of the second insertion portion 261 and has an axial center that is the same as the axial center B of the second insertion portion 261. A plurality of recessed portions 271 that extend parallel to the axial center B are formed at equally spaced intervals on the outer periphery of the second protruding portion 270. The lower end of the first protruding portion 230 and the lower end of the second protruding portion 270 are positioned above the bottom surface 65 of the presser plate 50. A black rectangular marker 79 in a right side view is drawn on the right side of the second protruding portion 270. The marker 79 indicates the vertical position of the axial center C of the second fitting portion 262. Although not shown in the drawings, a black rectangular marker in a left side view, similar to the marker 79, is drawn on the left side of the first protruding portion 230.

Positioning plates 240 and 280 have the same structure and are made of flexible material such as resin. The positioning plate 240 is a plate having a trapezoidal shape in which the front surface in a side view is the bottom surface. The positioning plate 240 has a recessed portion 242 that is recessed toward the rear on the front surface. The length of the recessed portion 242 in the up-down direction is smaller than the diameter of the first protruding portion 230 and larger than the diameter of the first insertion portion 221. A hole 241 that passes through in the left-right direction is formed in the positioning plate 240. The positioning plate 240 is arranged to the left of the first opposing portion 251 such that the rear portion of the first protruding portion 230 abuts against the recessed portion 242 of the positioning plate 240, and the positioning plate 240 is fixed to the left surface of the first opposing portion 251 by inserting a screw 291 through the hole 241 from the left and screwing the screw 291 into the fixing hole 255. The positioning plate 240 fixes the position of the eccentric pin 210 about the axial center B by abutting against the first protruding portion 230, while allowing the user to rotate the eccentric pin 210 about the axial center B. A recessed portion 282 and a hole 281, corresponding to the recessed portion 242 and the hole 241 of the positioning plate 240, are formed in the positioning plate 280, and the positioning plate 280 is fixed to the right surface of the second opposing portion 252 by a screw 292. The positioning plate 280 fixes the position of the eccentric pin 250 about the axial center B by abutting against the second protruding portion 270, while allowing the user to rotate the eccentric pin 250 about the axial center B.

The user can change the height of the first fitting portion 222 from the bottom surface 65 of the presser foot 205 by rotating the eccentric pin 210 with the marker drawn on the first protruding portion 230 as a marker. The user can change the height of the second fitting portion 262 from the bottom surface 65 of the presser foot 205 by rotating the eccentric pin 250 with the marker 79 as the marker. As a result, with the presser foot 205, it is possible to change the maximum protrusion amount of the upper feed dog 30 from the bottom surface 65 of the presser foot 205 when the presser foot 205 is mounted to the main body portion 3 and used with the sewing machine 1, similar to the presser foot 105. Therefore, the presser foot 205 of this embodiment displays the same effects as the presser foot 105 (refer to FIG. 9 and FIG. 10). The marker such as the marker 79 of the presser foot 205 may be omitted or the shape and/or arrangement thereof may be modified.

A presser foot 305 that is detachably mounted to the main body portion 3 of the upper feed device 2 will now be described with reference to FIG. 12. In FIG. 12, structure that is the same as the structure of the presser foot 5 (refer to FIG. 3) will be denoted by the same reference characters. As shown in FIG. 12, the presser foot 305 differs from the presser foot 5 in that the presser foot 305 has a first opposing portion 351 instead of the first opposing portion 51 of the presser foot 5, and has a second opposing portion 352 instead of the second opposing portion 52 of the presser foot 5. The presser foot 305 also differs from the presser foot 5 in that the presser foot 305 has a first pin 313 and a first protruding portion 314 instead of the first pin 53 and the first protruding portion 55 of the presser foot 5, and has a second pin 323 and a second protruding portion 324 instead of the second pin 54 and the second protruding portion 56 of the presser foot 5. All other structure of the presser foot 305 is the same as that of the presser foot 5. A description of the structure that is the same as that of the presser foot 5 will be omitted. Hereinafter, the first opposing portion 351, the second opposing portion 352, the first pin 313, the first protruding portion 314, the second pin 323, and the second protruding portion 324, which differ from the presser foot 5, will be described.

The first opposing portion 351 extends upward from the presser plate 50 on one side, i.e., the left side, of the openings 61 and 62 in direction M. First holes 353 and 354 that pass through in direction M are formed in the first opposing portion 351. The first holes 353 and 354 are screw holes having the same shape as each other when viewed from the side and are lined up vertically. The first hole 353 is formed above the first hole 354. The upper end portion of the first opposing portion 351 is a protruding portion 355 that is bent to the left and forms the left end of the first opposing portion 351. The protruding portion 355 protrudes farther to the left than the lower end portion of the first opposing portion 351. The second opposing portion 352 extends upward from the presser plate 50 on the other side, i.e., the right side, of the openings 61 and 62 in direction M, and faces the first opposing portion 351. Second holes 356 and 357 that pass through in direction M are formed in the second opposing portion 352. The second holes 356 and 357 are screw holes having the same shape as each other when viewed from the side and are lined up vertically. The second hole 356 is formed above the second hole 357. The upper end portion of the second opposing portion 352 is a protruding portion 358 that is bent to the right and forms the right end of the second opposing portion 352. The protruding portion 358 protrudes farther to the right than the lower end portion of the second opposing portion 352.

Figures 12A, 12B, 12C:
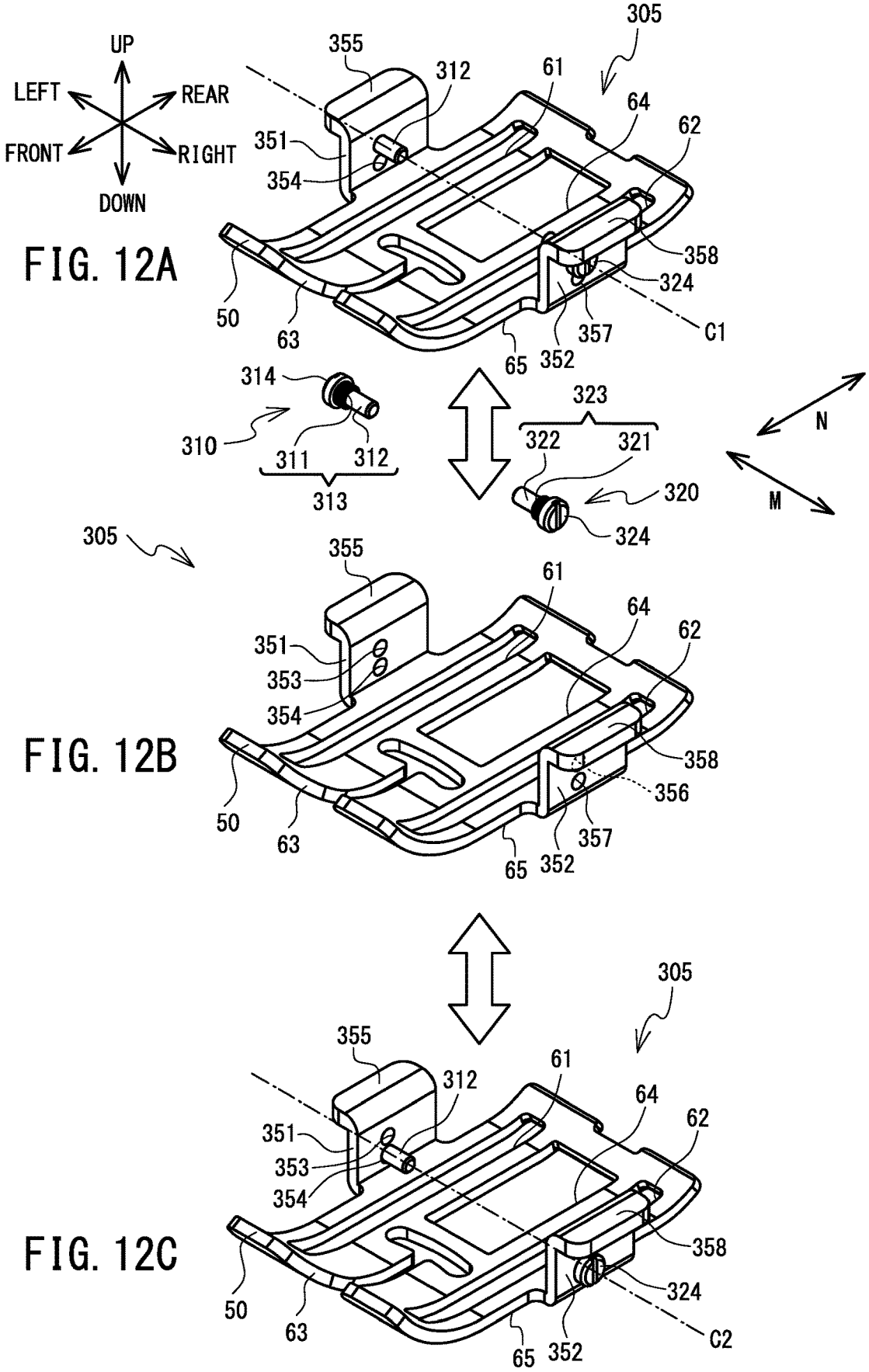
FIG. 12A is a perspective view of a presser foot in which a first insertion portion is inserted through a first hole and a second insertion portion is inserted through a second hole.
FIG. 12B is a perspective view of the presser foot in which the first insertion portion has been removed from the first hole and the second insertion portion has been removed from the second hole.
FIG. 12C is a perspective view of the presser foot in which the first insertion portion is inserted through another first hole and the second insertion portion is inserted through another second hole.

As shown in FIG. 12B, the first pin 313 and the first protruding portion 314 are integrally formed, and form a screw 310 similar to the screw 150. The head portion of the screw 310 is the first protruding portion 314, and the shaft portion of the screw 310 is the first pin 313. The first pin 313 includes a first insertion portion 311 and a first fitting portion 312. The first insertion portion 311 is inserted through one selected from the group of the first holes 353 and 354 of the first opposing portion 351. That is, the first pin 313 is inserted through one selected from the group of the first holes 353 and 354. The second pin 323 and the second protruding portion 324 are integrally formed and form a screw 320 similar to the screw 160. The second pin 323 includes a second insertion portion 321 and a second fitting portion 322. The second insertion portion 321 is inserted through one selected from the group of the second holes 356 and 357 of the second opposing portion 352. That is, the second pin 323 is inserted through one selected from the group of the second holes 356 and 357.

The user can adjust the length from the bottom surface 65 of the presser foot 305 to the first fitting portion 312 and the second fitting portion 322 by changing the first hole 353 or 354 through which the first pin 313 is inserted, and changing the second hole 356 or 357 through which the second pin 323 is inserted. As a result, with the presser foot 305, it is possible to change the maximum protrusion amount of the upper feed dog 30 from the bottom surface 65 of the presser foot 305 when the presser foot 305 is mounted to the main body portion 3 and used with the sewing machine 1. When the first pin 313 is inserted through the first hole 353 and the second pin 323 is inserted through the second hole 356 as shown in FIG. 12A, the length from the bottom surface 65 of the presser plate 50 to the first fitting portion 312 and the second fitting portion 322 is greater, and the maximum protrusion amount of the upper feed dog 30 (refer to FIG. 10) from the bottom surface 65 of the presser plate 50 is smaller, than they are when the first pin 313 is inserted through the first hole 354 and the second pin 323 is inserted through the second hole 357 as shown in FIG. 12C.

With the presser foot 305 of the embodiment described above, the first holes 353 and 354 that pass through in direction M are formed in the first opposing portion 351 and distances from the bottom surface 65 of the presser foot 305 to the first holes 353 and 354 are different each other. The second holes 356 and 357 that pass through in direction M are formed in second opposing portion 352 and distances from the bottom surface 65 of the presser foot 305 to the second holes 356 and 357 are different from each other. The first insertion portion 311 is inserted through one selected from the group of the first holes 353 and 354. The second insertion portion 321 is inserted through one selected from the group of the second holes 356 and 357. With the upper feed device 2 having the presser foot 305, it is possible to adjust the length from the bottom surface 65 of the presser foot 305 to the first fitting portion 312 and the second fitting portion 322 by changing the first hole 353 or 354 through which the first pin 313 is inserted, and changing the second hole 356 or 357 through which the second pin 323 is inserted. As a result, with the upper feed device 2, it is possible to change the length from the bottom surface 65 of the presser foot 305 to the first fitting portion 312 and the second fitting portion 322, and change the maximum protrusion amount of the upper feed dog 30 from the bottom surface 65, in accordance with the thickness and material and the like of the object to be sewn. When attaching or detaching the presser foot 305 to or from the main body portion 3, the user may grab the first protruding portion 314 and the second protruding portion 324, or may grab the protruding portions 355 or 358 or therebelow.

Figure 13:
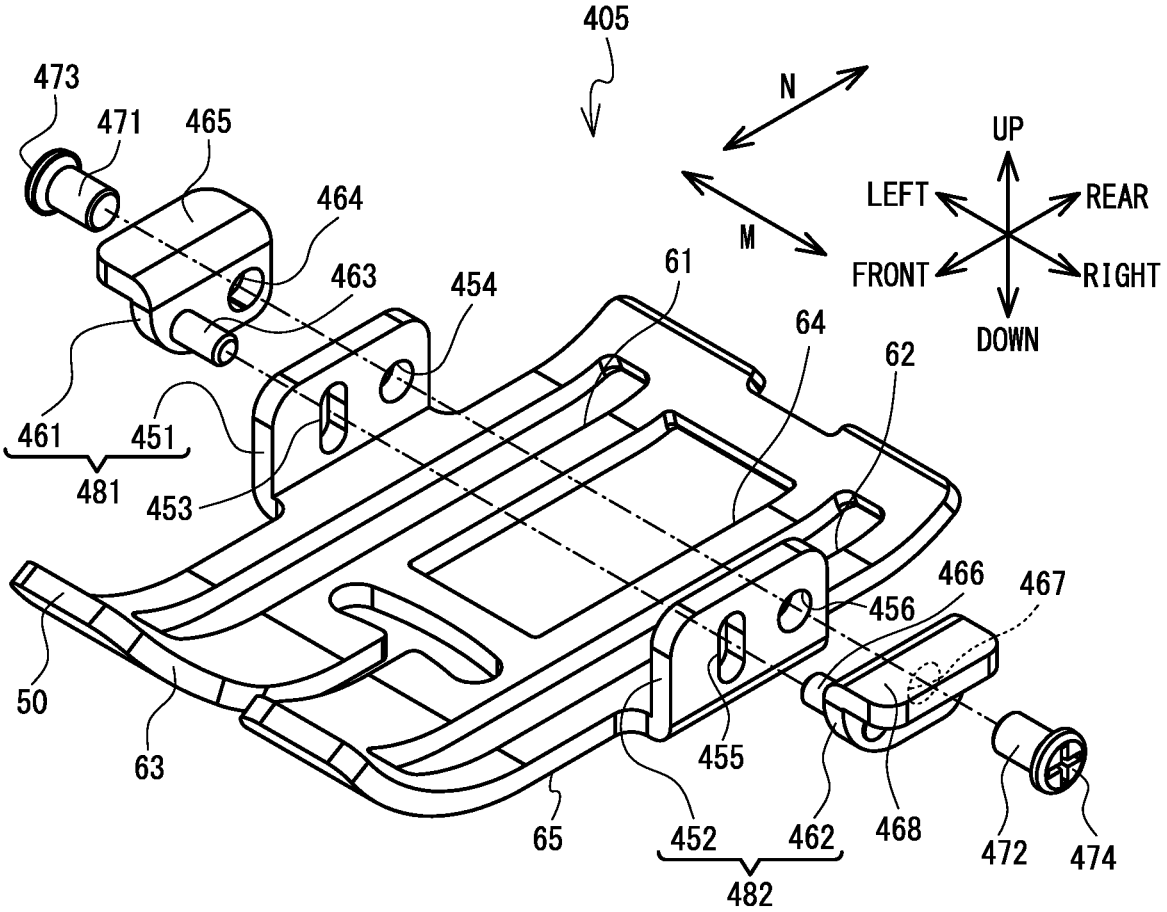
FIG. 13 is an exploded perspective view of a presser foot.
Figure 14:
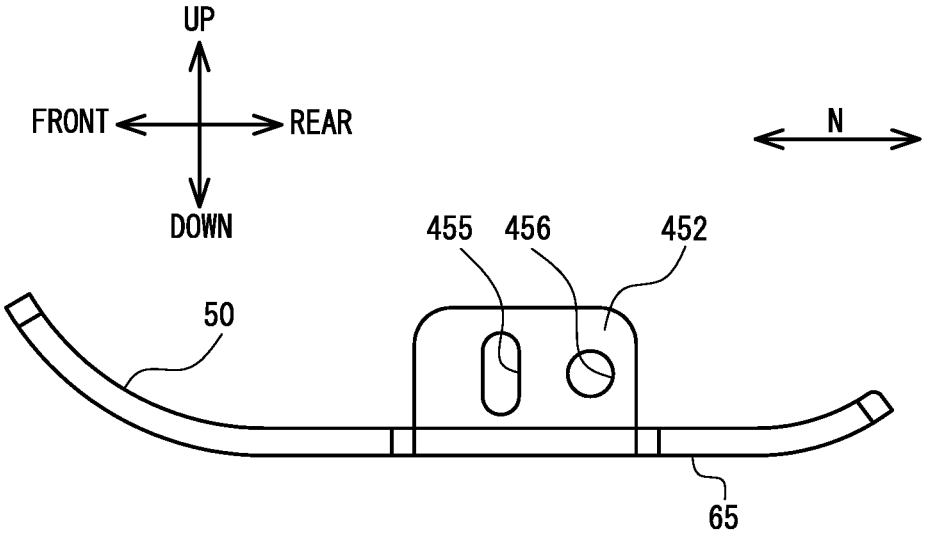
FIG. 14 is a right side view of a presser plate and a second support portion of the presser foot.

A presser foot 405 that is detachably mounted to the main body portion 3 of the upper feed device 2 will now be described with reference to FIG. 13 to FIG. 15. In FIG. 13 to FIG. 15, structure that is the same as the structure of the presser foot 5 (refer to FIG. 3) will be denoted by the same reference characters. As shown in FIG. 13 to FIG. 15, the presser foot 405 differs from the presser foot 5 in that the presser foot 405 has a first opposing portion 481 instead of the first opposing portion 51 of the presser foot 5, and has a second opposing portion 482 instead of the second opposing portion 52 of the presser foot 5. The presser foot 405 also differs from the presser foot 5 in that the presser foot 405 has a first pin 463 and a first protruding portion 465 instead of the first pin 53 and the first protruding portion 55 of the presser foot 5, and has a second pin 466 and a second protruding portion 468 instead of the second pin 54 and the second protruding portion 56 of the presser foot 5. All other structure of the presser foot 405 is the same as that of the presser foot 5. A description of the structure that is the same as that of the presser foot 5 will be omitted. Hereinafter, the first opposing portion 481, the second opposing portion 482, the first pin 463, the first protruding portion 465, the second pin 466, and the second protruding portion 468, which differ from the presser foot 5, will be described.

The first opposing portion 481 is provided with a first support portion 451 and a first adjusting plate 461. The first support portion 451 of the first opposing portion 481 extends upward from the presser plate 50 on one side, i.e., the left side, of the openings 61 and 62 in direction M. A first insertion hole 454 that passes through in direction M and a first guide hole 453 that is a long hole that extends in the up-down direction and passes through in direction M are formed in t first support portion 451. The first insertion hole 454 is formed in the rear side of the first guide hole 453. A hole 464 that passes through in the left-right direction is formed in a rear portion of the first adjusting plate 461. The first adjusting plate 461 is supported by a pin 471 that is inserted through the hole 464 and the first insertion hole 454, such that an end portion, i.e., the rear end portion, of the first adjusting plate 461 can pivot with respect to the first support portion 451. A head portion 473 of the pin 471 is arranged on the left side of the first adjusting plate 461. The first adjusting plate 461 is arranged on the left side of the first support portion 451. The second opposing portion 482 is provided with a second support portion 452 and a second adjusting plate 462. The second support portion 452 of the second opposing portion 482 extends upward from the presser plate 50 on the other side, i.e., the right side, of the openings 61 and 62 in direction M, and faces the first opposing portion 481. A second insertion hole 456 that passes through in direction M and a second guide hole 455 that is a long hole that extends in the up-down direction and passes through in direction M are formed in the second support portion 452. A hole 467 that passes through in the left-right direction is formed in a rear portion of the second adjusting plate 462. The second adjusting plate 462 is supported by a pin 472 that is inserted through the hole 467 and the second insertion hole 456, such that one end portion, i.e., the rear end portion, of the second adjusting plate 462 can pivot with respect to the second support portion 452. A head portion 474 of the pin 472 is arranged on the right side of the second adjusting plate 462. The second adjusting plate 462 is arranged on the right side of the second support portion 452. Although not shown in the drawings, fixing members such as washers for fixing the pins 471 and 472 so that they will not pivot with respect to the first support portion 451 and the second support portion 452 are attached to the pins 471 and 472.

The first pin 463 protrudes toward the right from the right surface of the first adjusting plate 461 in the front side of the hole 464. The first pin 463 has a cylindrical shape that is long in the left-right direction and has a substantially constant diameter. No bumps and dips such as screw threads are formed on the outer periphery of the first pin 463. In a state where the first adjusting plate 461 is supported by the first support portion 451, the first pin 463 is inserted through the first guide hole 453 from the left, and protrudes toward the side with the openings 61 and 62 (i.e., the right side) from the first opposing portion 481 (first support portion 451), and rotatably fits into the first groove 33 of the first mounting portion 31. The first protruding portion 465 is a portion that is provided on the upper end of the first adjusting plate 461 and bent to the side opposite the side with the openings 61 and 62. The second pin 466 protrudes toward the left from the left surface of the second adjusting plate 462 in the front side of the hole 467. The second pin 466 has a cylindrical shape that is long in the left-right direction and has a substantially constant diameter. No bumps and dips such as screw threads are formed on the outer periphery of the second pin 466. In a state where the second adjusting plate 462 is supported by the second support portion 452, the second pin 466 is inserted through the second guide hole 455 from the right, and protrudes toward the side with the openings 61 and 62 from the second opposing portion 482 (second support portion 452), and rotatably fits into the second groove 34 of the second mounting portion 32. The second protruding portion 468 is a portion that is provided on the upper end of the second adjusting plate 462 and bent to the side opposite the side with the openings 61 and 62. When attaching or detaching the presser foot 405 to or from the main body portion 3, the user may grab the first protruding portion 465 and the second protruding portion 468 or therebelow, i.e., any portion of the first adjusting plate 461 and the second adjusting plate 462, or may grab the head portion 473 of the pin 472 and the head portion 474 of the pin 472.

Figure 15A:
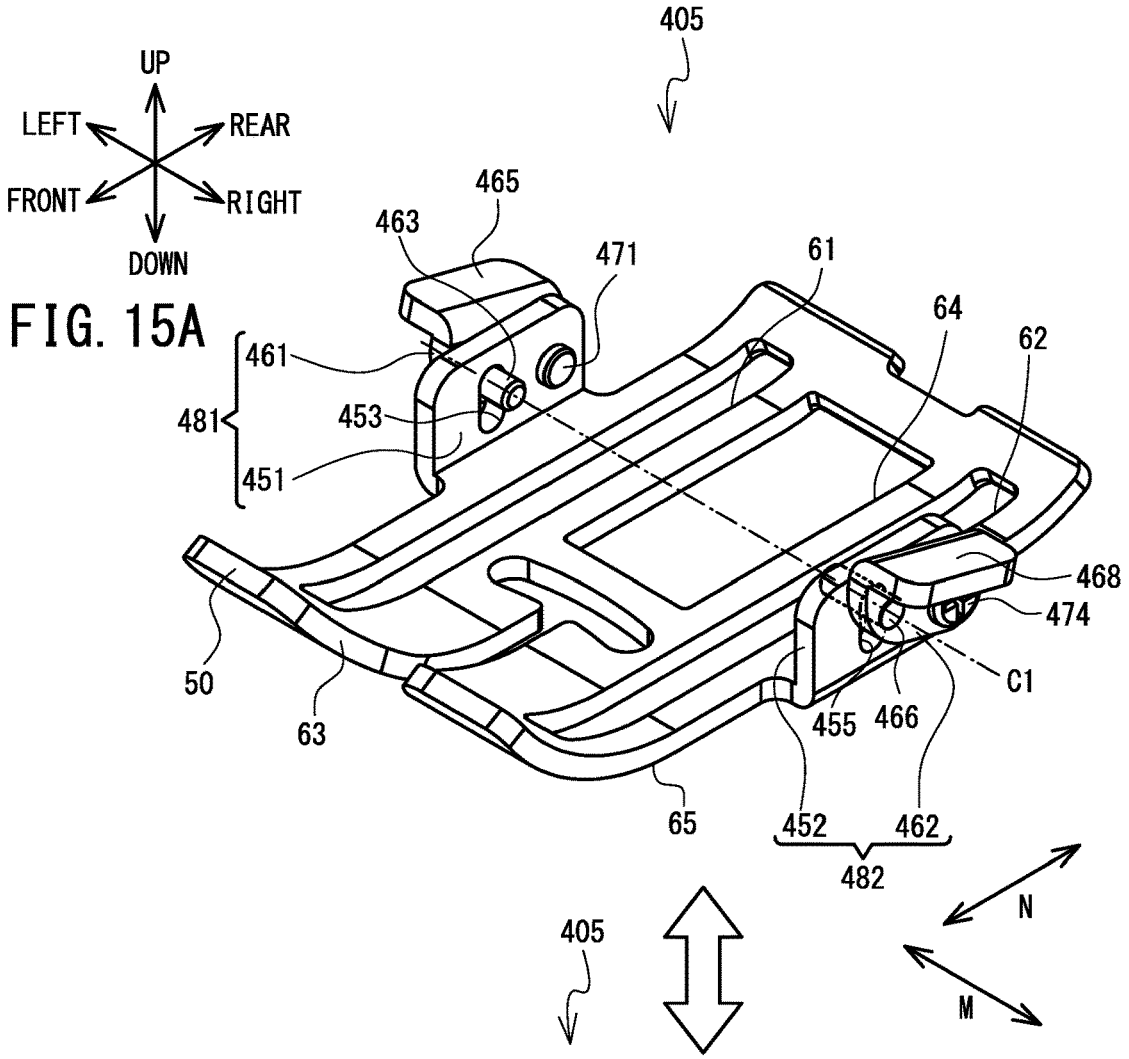
FIG. 15A is a perspective view of the presser foot in which a first pin is arranged in an upper end of a first guide hole and a second pin is arranged in an upper end of a second guide hole.
Figure 15B:
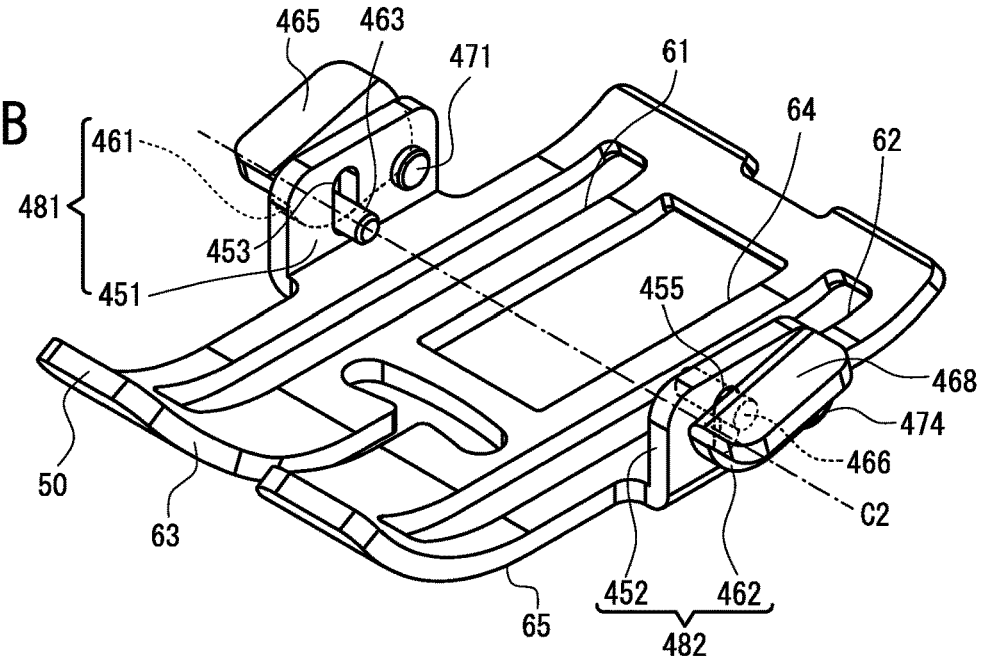
FIG. 15B is a perspective view of the presser foot in which the first pin is arranged in a lower end of the first guide hole and the second pin is arranged in a lower end of the second guide hole.

The user can change the height from the bottom surface 65 of the presser foot 405 to the first pin 463 by rotating the first adjusting plate 461 around the pin 471. After the position of the first pin 463 has been adjusted, the first adjusting plate 461 is fixed by the pin 471 so as not to pivot with respect to the first support portion 451. The user can change the height from the bottom surface 65 of the presser foot 405 to the second pin 466 by rotating the second adjusting plate 462 around the pin 472. After the position of the second pin 466 has been adjusted, the second adjusting plate 462 is fixed by the pin 472 so as not to pivot with respect to the second support portion 452. As a result, with the presser foot 405, it is possible to change the maximum protrusion amount of the upper feed dog 30 from the bottom surface 65 of the presser foot 405 when the presser foot 405 is mounted to the main body portion 3 and used with the sewing machine 1, similar to the presser foot 105. In FIG. 15A, the first pin 463 is arranged on an upper end portion of the first guide hole 453, and the second pin 466 is arranged on the upper end portion of the second guide hole 455. In FIG. 15B, the first pin 463 is arranged on a lower end portion of the first guide hole 453, and the second pin 466 is arranged on a lower end portion of the second guide hole 455. The maximum protrusion amount of the upper feed dog 30 from the bottom surface 65 in the case shown in FIG. 15A is less than the maximum protrusion amount of the upper feed dog 30 from the bottom surface 65 in the case shown in FIG. 15B.

The first opposing portion 481 of the presser foot 405 of the embodiment described above has the first support portion 451 and the first adjusting plate 461. The first support portion 451 has the first guide hole 453 that is a long hole that extends in the up-down direction and passes through in direction M. The first adjusting plate 461 is provided such that the rear end portion of the first adjusting plate 461 is supported in a manner able to pivot with respect to the first support portion 451. The second opposing portion 482 has the second support portion 452 and the second adjusting plate 462. The second support portion 452 has the second guide hole 455 that is a long hole that extends in the up-down direction and passes through in direction M. The second adjusting plate 462 is provided such that the rear end portion of the second adjusting plate 462 is supported in a manner able to pivot with respect to the first support portion 451. The first pin 463 protrudes towards the side with the openings 61 and 62 from the front end portion of the first adjusting plate 461 and is inserted through the first guide hole 453, and the position of the first pin 463 in the up-down direction can be changed in response to pivoting the first adjusting plate 461. The second pin 466 protrudes towards the side with the openings 61 and 62 from the front end portion of the second adjusting plate 462 and is inserted through the second guide hole 455, and the position of the second pin 466 in the up-down direction can be changed in response to pivoting the second adjusting plate 462. With the upper feed device 2 provided with the presser foot 405, the length from the bottom surface 65 of the presser foot 405 to the first pin 463 and the second pin 466 can be adjusted by pivoting the first adjusting plate 461 with respect to the first support portion 451, and pivoting the second adjusting plate 462 with respect to the second support portion 452. Therefore, with the upper feed device 2 provided with the presser foot 405, the user can change the maximum protrusion amount of the upper feed dog 30 that protrudes below the bottom surface 65 of the presser foot 405 by changing the length from the bottom surface 65 of the presser foot 405 to the first pin 463 and the second pin 466 in accordance with the thickness and material and the like of the object to be sewn. The pins 471 and 472 may be screws. In this case, the first insertion hole 454 and the second insertion hole 456 should be screw holes.

The upper feed device of the present disclosure is not limited to the embodiments described above. Various modifications may also be made without departing from the scope thereof. For example, the following modifications may be made as appropriate.

The structure of the sewing machine 1 to which the upper feed device 2 is mounted may be modified as appropriate. The structure of the upper feed device 2 may be modified as appropriate. The shapes of the presser plates 50 and 70 may be modified as appropriate. The shape, size, arrangement, and number of the openings 61 and 62 provided in the presser plates 50 and 70 may be modified as appropriate. A U-shaped opening that opens toward the front may be provided in the presser plate 50, and one or three or more openings may be provided. The first opposing portion 51 need only be on one end side in direction M, and may be provided between the left end of the presser plate 50 and the opening 61. Similarly, the second opposing portion 52 need only be on the other end side in direction M, and may be provided between the right end of the presser plate 50 and the opening 62.

The presser foot 5 does not have to be symmetrical about the center J in the left-right direction. The first pin 53 and the first protruding portion 55 may be formed separately. A screw thread may be formed on at least a portion of at least one selected from the group of the outer periphery of the first pin 53 and the outer periphery of the second pin 54. The first pin 53 and the second pin 54 may have a polygonal column shape or a polygonal cone shape. The first protruding portions 55, 83, 95, and 314 and the second protruding portions 56, 86, 96, and 324 do not have to have a cylindrical shape that extends in direction M, but may instead have a polygonal column shape that extends in direction M, for example.

The lower end of the first protruding portion 55 and the lower end of the second protruding portion 56 may be the same height as the bottom surface 65 of the presser foot 5. At least one selected from the group of the first pin 53 and the first protruding portion 55 may be integrally formed with the first opposing portion 51. At least one selected from the group of the second pin 54 and the second protruding portion 56 may be integrally formed with the second opposing portion 52.

The extension range D2 of the first pin 53 and the extension range D1 of the first protruding portion 55 do not have to overlap in direction N. The extension range D2 of the second pin 54 and the extension range D1 of the second protruding portion 56 do not have to overlap in direction N. At least one selected from the group of the first pin 53, the second pin 54, the first protruding portion 55, and the second protruding portion 56 does not have to be provided on the same straight line E that extends in direction M. The urging members 41 and 42 may be omitted if the first mounting portion 31 and the second mounting portion 32 are formed by elastic members, or the like. The urging members 41 and 42 may be integrally formed. The different structures of the presser feet 5, 7, 8, 9, 105, 205, 305, and 405 may be applied to another presser foot as long as the structures do not conflict. For example, the protruding portion 355 and the protruding portion 358 of the presser foot 305 may be formed on the first opposing portion and the second opposing portion of the presser feet 5, 7, 8, 9, 105, and 205. The positions where the protruding portion 355 and the protruding portion 358 are formed, and the shapes and the like of those portions, may be modified as appropriate. For example, the protruding portion 355 and the protruding portion 358 may be formed only on a portion in the front-rear direction of the first opposing portion 351 and the second opposing portion 352.

In the presser foot 405, the structure that pivotally supports the first adjusting plate 461 with respect to the first support portion 451, and the structure that pivotally supports the second adjusting plate 462 with respect to the second support portion 452 may be modified as appropriate. For example, if the first support portion 451 is provided with a pin protruding toward the left instead of the first insertion hole 454, the first adjusting plate 461 may be pivotally supported with respect to the first support portion 451 by the pin being inserted through the hole 464. With the presser foot 405, the first protruding portion 465 provided on the upper end portion of the first adjusting plate 461 may be omitted, and the head portion 473 of the pin 471 may serve as the first protruding portion.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An upper feed device comprising:

a main body portion configured to be mounted to a presser bar of a sewing machine, the main body portion having an upper feed dog, a first mounting portion, and a second mounting portion, the upper feed dog being configured to convey an object to be sewn in conjunction with up and down movement of a needle bar of the sewing machine, the first mounting portion having a first groove opening downward, and the second mounting portion having a second groove opening downward, and a presser foot configured to be detachably mounted to the main body portion, the presser foot having a presser plate, a first opposing portion, a second opposing portion, a first pin, a first protruding portion, a second pin, and a second protruding portion, an opening through which the upper feed dog is inserted being formed in the presser plate, the first opposing portion extending upward from the presser plate on one side of the opening in the lateral direction of the opening, the first pin protruding on a side with the opening from the first opposing portion, and being configured to rotatably fit into the first groove of the first mounting portion, the first protruding portion protruding on an opposite side to the side with the opening from the first opposing portion, the second opposing portion extending upward from the presser plate on another side of the opening opposite from the first opposing plate, in the lateral direction of the opening, and facing the first opposing portion, the second pin protruding on a side with the opening from the second opposing portion, and being configured to rotatably fit into the second groove of the second mounting portion, the second protruding portion protruding on an opposite side to the side with the opening from the second opposing portion, wherein in a longitudinal direction of the opening, an extension range of the first protruding portion overlaps with an extension range of the first pin, and an extension range of the second protruding portion overlaps with an extension range of the second pin, at least a portion of each of the first protruding portion, the first pin, the second protruding portion, and the second pin are provided along a same axis extending in the lateral direction of the opening, a first hole passing through in the lateral direction of the opening is formed in the first opposing portion, the first pin and the first protruding portion are integrally formed, and have a first insertion portion to be inserted into the first hole and a first fitting portion to be fit into the first groove, a second hole passing through in the lateral direction of the opening is formed in the second opposing portion, the second pin and the second protruding portion are integrally formed, and have a second insertion portion to be inserted into the second hole and a second fitting portion to be fit into the second groove, an axial center of the first insertion portion extending in the lateral direction of the opening differs from an axial center of the first fitting portion extending in the lateral direction of the opening, and an axial center of the second insertion portion extending in the lateral direction of the opening differs from an axial center of the second fitting portion extending in the lateral direction of the opening.

2. The upper feed device according to claim 1, wherein the first hole and the second hole are both screw holes, the first insertion portion and the second insertion portion each have a screw thread to be screwed one into each of the screw holes, and the first protruding portion and the second protruding portion are both head portions of screws.

3. The upper feed device according to claim 1, wherein a maximum length of the first fitting portion in a radial direction orthogonal to the lateral direction of the opening is shorter than a maximum length of the first insertion portion, and a maximum length of the second fitting portion in the radial direction is shorter than a maximum length of the second insertion portion.

4. The upper feed device according to claim 1, wherein a plurality of first holes passing through in the lateral direction of the opening are formed in the first opposing portion, and distances from a bottom surface of the presser foot to each of the plurality of the first holes are different from each other, a plurality of second holes passing through in the lateral direction of the opening are formed in the second opposing portion, and distances from the bottom surface of the presser foot to the each of plurality of the second holes are different from each other, the first insertion portion is inserted into one selected from the group of the plurality of the first holes, and the second insertion portion is inserted into one selected from the group of the plurality of the second holes.

5. The upper feed device according to claim 1, wherein the first protruding portion has a pair of first protrusions arranged with the first pin between the pair of first protrusions, in the longitudinal direction of the opening, and the second protruding portion has a pair of second protrusions arranged with the second pin between the pair of second protrusions, in the longitudinal direction of the opening.

6. The upper feed device according to claim 1, wherein a first portion of the first protruding portion protruding farthest toward the opposite side to the side with the opening from the first opposing portion, and a second portion of the second protruding portion protruding farthest toward the opposite side to the side with the opening from the second opposing portion are both positioned above a bottom surface of the presser plate.

7. The upper feed device according to claim 1, wherein a lower end of the first protruding portion and a lower end of the second protruding portion are both positioned above a bottom surface of the presser plate.

8. The upper feed device according to claim 1, wherein the first opposing portion has a first support portion and a first adjusting plate, a first guide hole being formed in the first support portion, the first guide hole being longer in an up-down direction than in a front-rear direction and passing through in the lateral direction of the opening, the first adjusting plate being such that an end portion thereof is pivotally supported with respect to the first support portion, the second opposing portion has a second support portion and a second adjusting plate, a second guide hole being formed in the second support portion, the second guide hole being longer in the up-down direction than in the front-rear direction and passing through in the lateral direction of the opening, the second adjusting plate being such that an end portion thereof is pivotally supported with respect to the second support portion, the first pin protrudes toward the side with the opening from the other end portion of the first adjusting plate and is inserted through the first guide hole, a position of the first pin in the up-down direction changing in response to pivoting of the first adjusting plate, and the second pin protrudes toward the side with the opening from the other end portion of the second adjusting plate and is inserted through the second guide hole, a position of the second pin in the up-down direction changing in response to pivoting of the second adjusting plate.

9. The upper feed device according to claim 1, wherein the main body portion further includes an urging member urging the first pin fitted into the first groove of the first mounting portion and the second pin fitted into the second groove of the second mounting portion in a direction orthogonal to the downward direction.

10. An upper feed device comprising:

a main body portion configured to be mounted to a presser bar of a sewing machine, the main body portion having an upper feed dog, a first mounting portion, and a second mounting portion, the upper feed dog being configured to convey an object to be sewn in conjunction with up and down movement of a needle bar of the sewing machine, the first mounting portion having a first groove opening downward, and the second mounting portion having a second groove opening downward, and a presser foot configured to be detachably mounted to the main body portion, the presser foot having a presser plate, a first opposing portion, a second opposing portion, a first pin, a first protruding portion, a second pin, and a second protruding portion, an opening through which the upper feed dog is inserted being formed in the presser plate, the first opposing portion extending upward from the presser plate on one side of the opening in the lateral direction of the opening, the first pin protruding on a side with the opening from the first opposing portion, and being configured to rotatably fit into the first groove of the first mounting portion, the first protruding portion protruding on an opposite side to the side with the opening from the first opposing portion, the second opposing portion extending upward from the presser plate on another side of the opening opposite from the first opposing plate, in the lateral direction of the opening, and facing the first opposing portion, the second pin protruding on a side with the opening from the second opposing portion, and being configured to rotatably fit into the second groove of the second mounting portion, the second protruding portion protruding on an opposite side to the side with the opening from the second opposing portion, wherein in a longitudinal direction of the opening, an extension range of the first protruding portion overlaps with an extension range of the first pin, and an extension range of the second protruding portion overlaps with an extension range of the second pin, at least a portion of each of the first protruding portion, the first pin, the second protruding portion, and the second pin are provided along a same axis extending in the lateral direction of the opening, a first hole passing through in the lateral direction of the opening is formed in the first opposing portion, the first pin and the first protruding portion are integrally formed, and have a first insertion portion to be inserted into the first hole and a first fitting portion to be fit into the first groove, a second hole passing through in the lateral direction of the opening is formed in the second opposing portion, the second pin and the second protruding portion are integrally formed, and have a second insertion portion to be inserted into the second hole and a second fitting portion to be fit into the second groove, a plurality of first holes passing through in the lateral direction of the opening are formed in the first opposing portion, and distances from a bottom surface of the presser foot to each of the plurality of the first holes are different from each other, a plurality of second holes passing through in the lateral direction of the opening are formed in the second opposing portion, and distances from the bottom surface of the presser foot to the each of plurality of the second holes are different from each other, the first insertion portion is inserted into one selected from the group of the plurality of the first holes, and the second insertion portion is inserted into one selected from the group of the plurality of the second holes.

11. An upper feed device comprising:

a main body portion configured to be mounted to a presser bar of a sewing machine, the main body portion having an upper feed dog, a first mounting portion, and a second mounting portion, the upper feed dog being configured to convey an object to be sewn in conjunction with up and down movement of a needle bar of the sewing machine, the first mounting portion having a first groove opening downward, and the second mounting portion having a second groove opening downward, and a presser foot configured to be detachably mounted to the main body portion, the presser foot having a presser plate, a first opposing portion, a second opposing portion, a first pin, a first protruding portion, a second pin, and a second protruding portion, an opening through which the upper feed dog is inserted being formed in the presser plate, the first opposing portion extending upward from the presser plate on one side of the opening in the lateral direction of the opening, the first pin protruding on a side with the opening from the first opposing portion, and being configured to rotatably fit into the first groove of the first mounting portion, the first protruding portion protruding on an opposite side to the side with the opening from the first opposing portion, the second opposing portion extending upward from the presser plate on another side of the opening opposite from the first opposing plate, in the lateral direction of the opening, and facing the first opposing portion, the second pin protruding on a side with the opening from the second opposing portion, and being configured to rotatably fit into the second groove of the second mounting portion, the second protruding portion protruding on an opposite side to the side with the opening from the second opposing portion, wherein the first opposing portion has a first support portion and a first adjusting plate, a first guide hole being formed in the first support portion, the first guide hole being longer in an up-down direction than in a front-rear direction and passing through in the lateral direction of the opening, the first adjusting plate being such that an end portion thereof is pivotally supported with respect to the first support portion, the second opposing portion has a second support portion and a second adjusting plate, a second guide hole being formed in the second support portion, the second guide hole being longer in the up-down direction than in the front-rear direction and passing through in the lateral direction of the opening, the second adjusting plate being such that an end portion thereof is pivotally supported with respect to the second support portion, the first pin protrudes toward the side with the opening from the other end portion of the first adjusting plate and is inserted through the first guide hole, a position of the first pin in the up-down direction changing in response to pivoting of the first adjusting plate, and the second pin protrudes toward the side with the opening from the other end portion of the second adjusting plate and is inserted through the second guide hole, a position of the second pin in the up-down direction changing in response to pivoting of the second adjusting plate.

* * * * *